US010907808B2

(12) United States Patent
Wronski et al.

(10) Patent No.: US 10,907,808 B2
(45) Date of Patent: Feb. 2, 2021

(54) PLASTER FRAME ASSEMBLY FOR RECESSED LUMINAIRES

(71) Applicant: SIGNIFY HOLDING B.V., Eindhoven (NL)

(72) Inventors: Grzegorz Wronski, Peachtree City, GA (US); Steven Pyshos, Peachtree City, GA (US); Oliver Ernst, Peachtree City, GA (US); Wei Zhao, Shanghai (CN); Rongxiu Huang, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/851,324

(22) Filed: Apr. 17, 2020

(65) Prior Publication Data

US 2020/0240619 A1 Jul. 30, 2020

Related U.S. Application Data

(62) Division of application No. 15/587,298, filed on May 4, 2017, now Pat. No. 10,627,084.

(51) Int. Cl.
*F21V 21/04* (2006.01)
*F21V 31/00* (2006.01)

(52) U.S. Cl.
CPC ..... *F21V 21/047* (2013.01); *F21V 31/005* (2013.01)

(58) Field of Classification Search
USPC ..... 248/342, 343, 344; 362/364, 365
See application file for complete search history.

(56) References Cited

U.S. PATENT DOCUMENTS

| | | | | |
|---|---|---|---|---|
| 4,972,339 | A | 11/1990 | Gabrius | |
| 5,044,985 | A | 9/1991 | Sheen | |
| 5,746,507 | A * | 5/1998 | Lee | F21V 21/04 362/147 |
| 6,467,640 | B1 | 10/2002 | Hung | |
| 6,474,846 | B1 * | 11/2002 | Kelmelis | F21V 17/164 248/231.91 |
| 6,751,096 | B2 | 6/2004 | Aldon | |
| 7,530,705 | B2 * | 5/2009 | Czech | F21S 8/02 248/288.11 |
| 7,798,532 | B2 | 9/2010 | Huber | |

(Continued)

OTHER PUBLICATIONS

Halo E5TATNB; Eaton Lighting Spec Sheet; Feb. 9, 2016.

(Continued)

*Primary Examiner* — Alfred J Wujciak

(57) ABSTRACT

A plaster frame assembly includes a base plate that has a base wall and a plurality of side walls that extend substantially perpendicular to the base wall from a perimeter of the base wall. The base wall includes at least one regressed pad that has a plurality of perforations. The plurality of perforations receive one or more securing fasteners therethrough to secure or fasten the base plate to the ceiling. Furthermore, the base wall includes one or more sealing features that provide an air-tight sealing for a recessed housing can received through and retained in a can receiving opening formed in the base wall. The one or more sealing features include multiple collar sections that define a groove for receiving a sealing member, and one or more sealing tabs disposed between the multiple collar sections and configured to seal one or more adjustment apertures of the recessed housing can.

19 Claims, 22 Drawing Sheets

(56) References Cited

U.S. PATENT DOCUMENTS

| | | | | |
|---|---|---|---|---|
| 7,874,708 | B1 | 1/2011 | Jones et al. | |
| 8,408,759 | B1 | 4/2013 | Rashidi | |
| 8,939,418 | B2 * | 1/2015 | Green | F16M 13/022 248/343 |
| 9,062,837 | B2 | 6/2015 | Wronski et al. | |
| 9,500,352 | B2 | 11/2016 | Van Winkle | |
| 2002/0070043 | A1 | 6/2002 | Kitajima | |
| 2005/0183344 | A1 * | 8/2005 | Ziobro | F21V 21/04 52/20 |
| 2007/0272816 | A1 * | 11/2007 | Friederich | F16M 13/027 248/343 |
| 2015/0233402 | A1 * | 8/2015 | Hudson | B62D 33/077 24/456 |

OTHER PUBLICATIONS

Halo E7 Installation Instructions; Eaton Lighting Jan. 14, 2016.
Amazon, RSA Qct 900 Quiet Ceiling Round Housings, Jan. 1, 2014; https://www.amazon.com/Quiet-Ceiling-Construction-Recessed-Housing/dp/B00JU70FC2.

* cited by examiner

PLASTER FRAME ASSEMBLY FOR RECESSED LUMINAIRES

CROSS-REFERENCE TO RELATED APPLICATIONS

The present application is a divisional application of and claims priority to U.S. patent application Ser. No. 15/587,298, filed May 4, 2017, and titled "Plaster Frame Assembly For Recessed Luminaires," the entire content of which is hereby incorporated herein by reference.

TECHNICAL FIELD

Embodiments of the present disclosure relate generally to mounting structures, and more particularly to a plaster frame assembly for mounting recessed luminaires in a ceiling or a similar mounting surface.

BACKGROUND

A recessed luminaire may include a recessed housing can that is mounted in a ceiling using a plaster frame. Further, the recessed luminaire may include a light source and a finishing section that are configured to fit inside the recessed housing can. The finishing section may include a main body, one or more reflectors, and a trim ring that is integral to the main body. In one example, the finishing section may be retained within the recessed housing can using a friction type retention system, e.g., friction blades. Typically, to install the finishing section in the recessed housing can, the finishing section may be inserted into an opening of the recessed housing can till the friction blades of the finishing section engage the inner surface of the recessed housing can and the trim ring of the finishing section engages the ceiling to eliminate gaps between the trim ring of the finishing section and the ceiling. However, after installation, the plaster frame and/or the recessed housing can of the recessed luminaire may settle creating an undesirable gap between the trim ring of the finishing section and the ceiling.

For example, as illustrated in FIGS. 1 and 2, a plaster frame assembly 106 may include hanger bars 103 and a base plate 105 that retains a recessed housing can 102. The hanger bars 103 may be coupled to the base plate 105. Further, the hanger bars 103 may be fastened to the rafters or joists 101 to retain the plaster frame assembly 106 and the recessed housing can 102 in a space 110 between a lower finished surface ceiling 104 (herein 'lower ceiling 104') and an upper structural ceiling 107 (herein 'upper ceiling 107'). Before installation of a finishing section 304 in the recessed housing can 102, as illustrated in FIGS. 1 and 2, the plaster frame assembly 106 may be disposed in the space 110 such that the base plate 105 of the plaster frame assembly 106 rests on and engages a top surface 204 of the lower ceiling 104 without any gaps in between the base plate 105 and the top surface 204 of the lower ceiling 104. However, when a finishing section 304 having a trim ring 306 (shown in FIG. 3) is inserted into the recessed housing can 102 such that the trim ring 306 engages the bottom surface 206 of the lower ceiling 104, the hanger bars 103 of the plaster frame assembly 106 that holds the base plate 105 and the recessed housing can 102 may bend upwards because of the friction between the friction blades of the finishing section 304 and the inner surface of the recessed housing can 102. As the hanger bars 103 bend upwards, as illustrated in FIGS. 3 and 4, the base plate 105 that is coupled to the hanger bars 103 may also move upwards creating a gap 402 in between the base plate 105 and the top surface 204 of the lower ceiling 104.

Once the finishing section 304 is installed within the recessed housing can 102, the hanger bars 103 and the base plate 105 of the plaster frame assembly 106 gradually revert back to their default position. Consequently, the recessed housing can 102 coupled to the base plate 105 and the finishing section 304 installed in the recessed housing can 102 also shift downward to their default position, as illustrated in FIG. 5. When the finishing section 304 that is coupled to the recessed housing can 102 shifts downward, a gap 502 may be created in between the trim ring 306 of the finishing section 304 and a bottom surface 206 of the lower ceiling 104 as illustrated in FIG. 5. Said gap 502 between the trim ring 306 of the finishing section and the ceiling 104 may be undesirable and unsightly.

Further, in other examples, conventional plaster frame assemblies may not provide an air-tight sealing of the recessed housing cans coupled thereto. Air leakage through openings that are formed in the recessed housing cans and through other openings that are formed when the recessed housing cans are installed in the ceiling using the conventional plaster frame assemblies may negatively impact an energy efficiency of a building in which the recessed housing cans are installed to provide recessed lighting. Further, such openings may expose the components disposed in the recessed housing can, such as the light source, to environmental factors (dust, dirt, etc.) which in turn reduces an efficiency and/or durability of the recessed luminaires.

SUMMARY

In one aspect, the present disclosure can relate to a plaster frame assembly that includes a base plate. In particular, the base plate includes a base wall having a can receiving opening formed therein. The can receiving opening is configured to receive a recessed housing can of a recessed luminaire therethrough. Further, the base wall includes at least one regressed pad formed therein. The at least one regressed pad includes a plurality of perforations that are configured to receive one or more securing fasteners therethrough to fasten the base plate to a ceiling. Additionally, the base plate includes a plurality of side walls that extend substantially perpendicular to the base wall from a perimeter of the base wall. The at least one regressed pad is disposed between the plurality of side walls and the can receiving opening.

In another aspect, the present disclosure can relate to a plaster frame assembly that includes a base plate. In particular, the base plate includes a base wall that has a can receiving opening formed therein. Further, the base wall has a plurality of sealing features that disposed at a perimeter of the can receiving opening. The plurality of sealing features are configured to provide an air-tight sealing for the recessed housing can. The plurality of sealing features include a plurality of collar sections that extend inward towards the can receiving opening from at least a portion of a perimeter of the can receiving opening. Additionally, the plurality of sealing features include one or more sealing tabs that are disposed in between the plurality of collar sections. Each sealing tab extends inward towards the can receiving opening from a remainder portion of the perimeter of the can receiving opening. The one or more sealing tabs are disposed in between the plurality of collar sections such that a portion of the one or more sealing tabs forms a continuous body with a portion of the plurality of collar sections.

In yet another aspect, the present disclosure can relate to a plaster frame assembly that includes a base plate. In particular, the base plate includes a base wall that has a can receiving opening formed in the base wall. The can receiving opening is configured to receive a recessed housing can of a recessed luminaire therethrough. Further, the base wall has at least one regressed pad formed therein. The at least one regressed pad includes a plurality of perforations that are configured to receive one or more securing fasteners therethrough to fasten the base plate to a ceiling. Furthermore, the base wall includes a plurality of sealing features that are configured to provide an air-tight sealing for the recessed housing can. Additionally, the base plate includes a plurality of side walls that extend substantially perpendicular to the base wall from a perimeter of the base wall. The at least one regressed pad is disposed in between the plurality of side walls and the can receiving opening. The plaster frame assembly also includes a pair of hanger bar assemblies that include a first hanger bar assembly coupled to one side wall of the plurality of side walls of the base plate and a second hanger bar assembly coupled to an opposite side wall.

These and other aspect, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
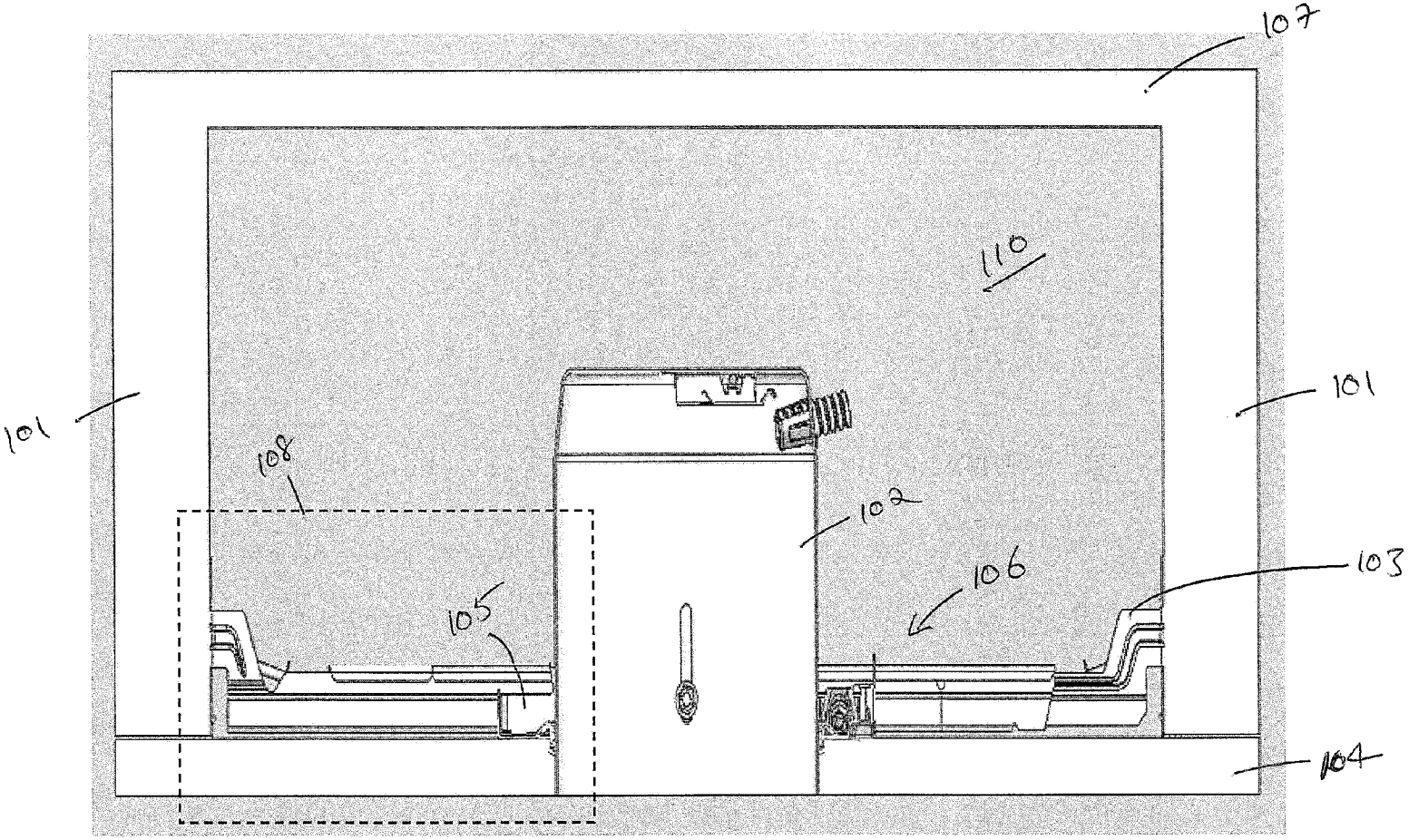
FIG. 1 illustrates a cross-section view of a conventional plaster frame assembly with a recessed housing can coupled thereto and disposed above a lower ceiling prior to installing the finishing section in the recessed housing can, in accordance with example embodiments of a prior art.
Figure 2:
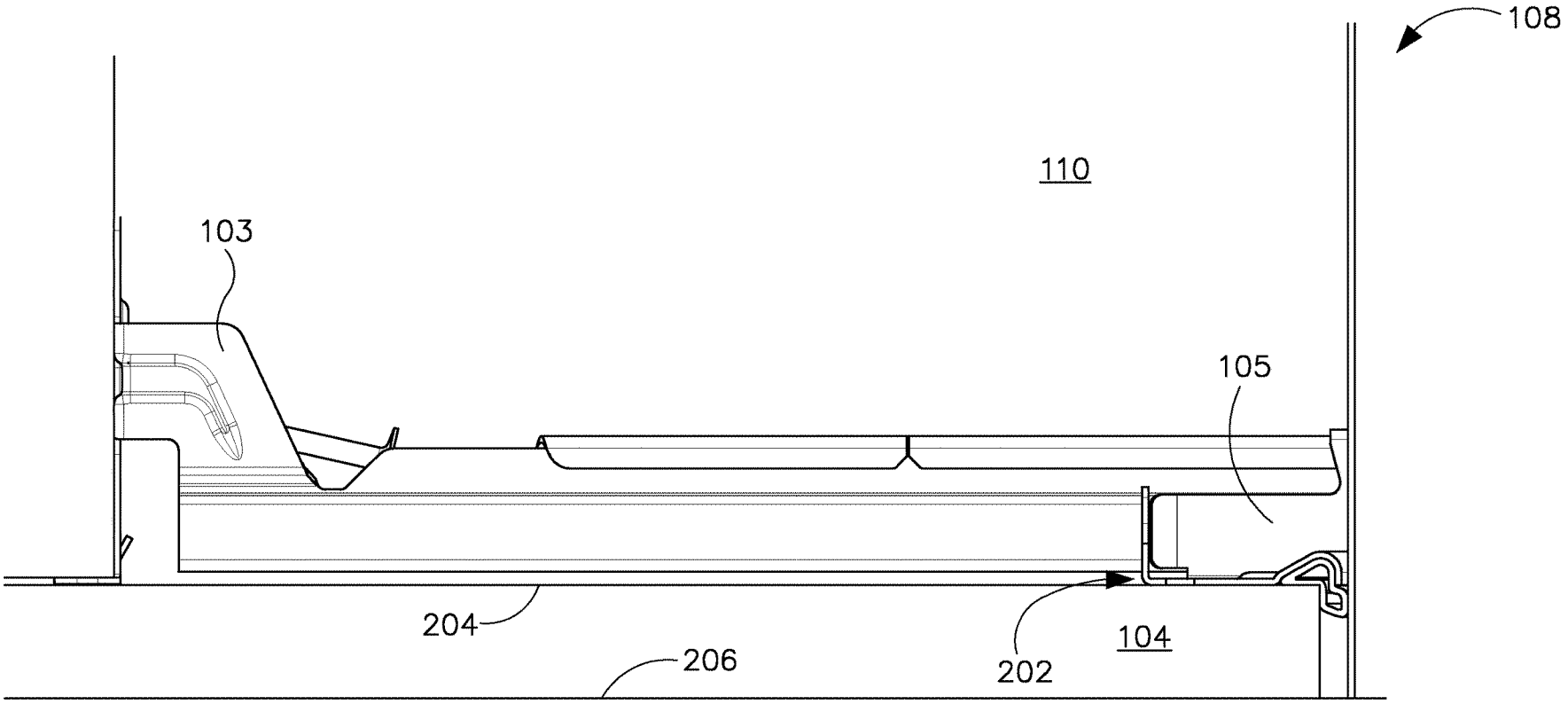
FIG. 2 illustrates an enlarged view of a portion of FIG. 1 to show how the base plate of the conventional plaster frame assembly rests on and engages the lower ceiling prior to installing the finishing section in the recessed housing can, in accordance with example embodiments of a prior art.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positioning may be exaggerated to help visually convey such principles.

DETAILED DESCRIPTION OF EXAMPLE EMBODIMENTS

The present disclosure describes an example plaster frame assembly that includes a pair of hanger bars and a base plate that is coupled to the pair of hanger bars. The hanger bars may be fastened at their respective ends to joists, rafters and/or other structural features of a building such that the base plate and the recessed housing can retained by the base plate are disposed in a space between the pair of joists or rafters 101, a lower ceiling 104, and an upper ceiling 107 (upper ceiling, lower ceiling, and support members shown in FIGS. 1 and 3) of the building. The lower ceiling may include any appropriate finished surface ceiling, such as, a drywall ceiling (e.g., sheetrock, gypsum wallboard, etc.), lath and plaster ceiling, wooden ceiling, magnesium oxide board ceiling etc.

The base plate of the plaster frame assembly includes a plurality of pads formed therein, where each pad includes a plurality of perforations having any appropriate geometric and/or non-geometric shape, such as, circular holes, elongated slots, etc. The perforations of each pad are configured to receive one or more fasteners therethrough to securely retain or fasten the base plate of the plaster frame assembly to the ceiling. In particular, the base plate of the plaster frame assembly may be secured or fastened to the ceiling to eliminate the formation or reintroduction of a gap 502 in between the trim ring of a finishing section and the ceiling over time after the finishing section is installed in the recessed housing can retained by the base plate.

Figure 3:
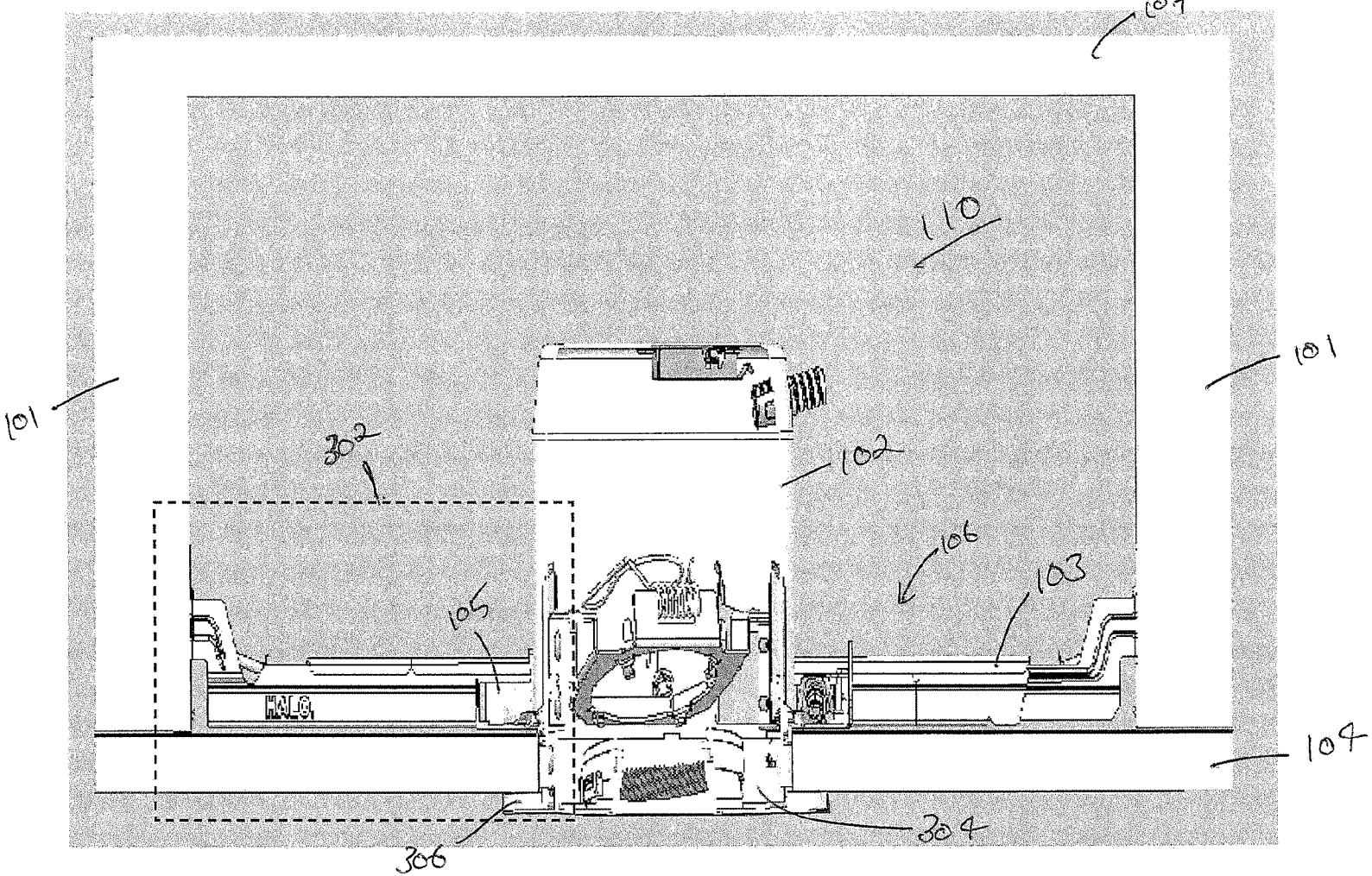
FIG. 3 illustrates a cross-section view of the conventional plaster frame assembly with the recessed housing can when a finishing section is installed in the recessed housing can such that the trim ring of the finishing section engages the lower ceiling to eliminate a gap between the trim ring and the ceiling, in accordance with example embodiments of a prior art.
Figure 4:
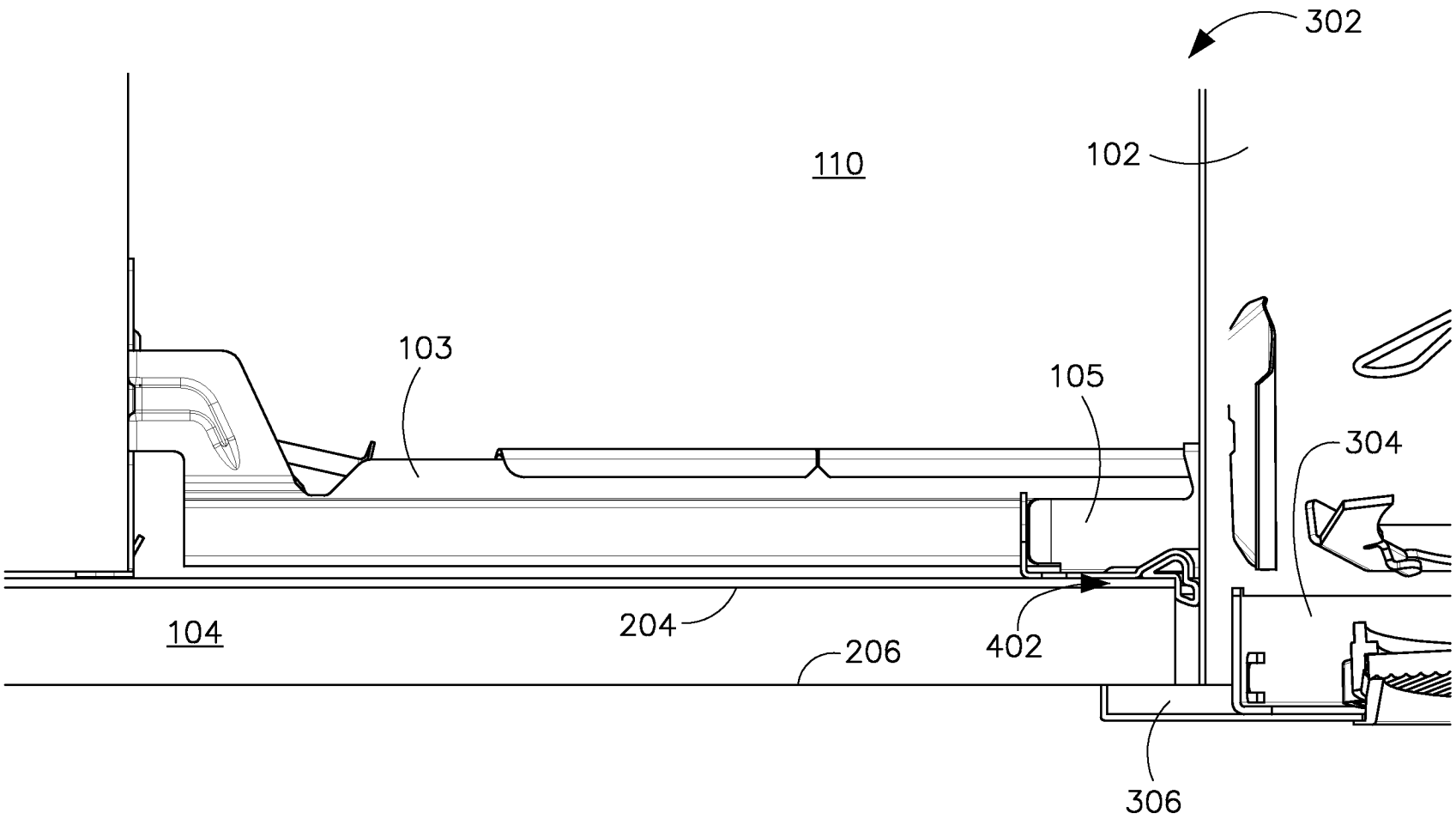
FIG. 4 illustrates an enlarged view of a portion of FIG. 3 to show a gap that is formed between the base plate of the conventional plaster frame assembly and the lower ceiling when the finishing section is installed in the recessed housing can, in accordance with example embodiments of a prior art.
Figure 5:
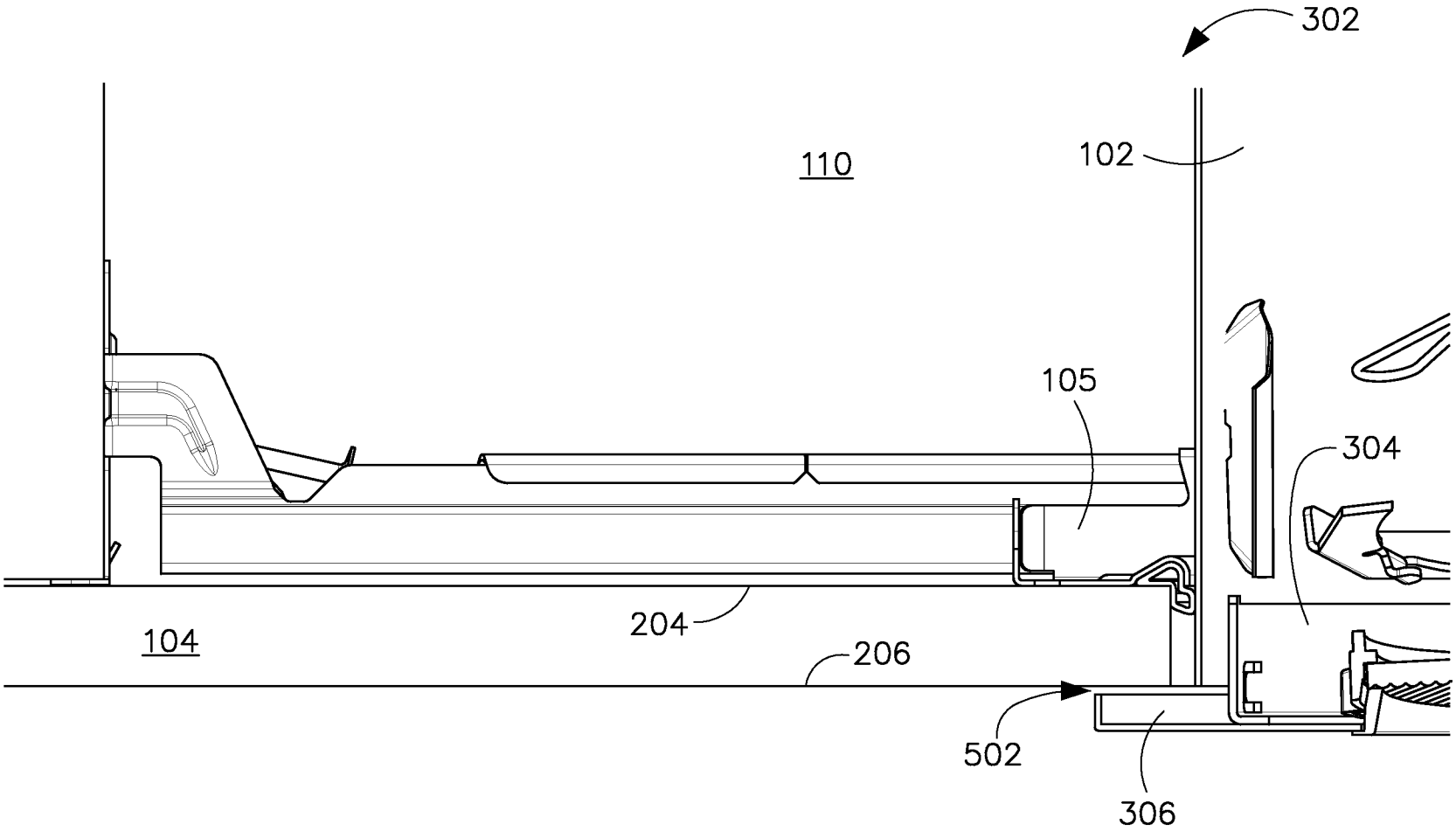
FIG. 5 illustrates an enlarged view of a portion of FIG. 3 to show a gap that is formed between the trim ring of the finishing section and the lower ceiling over time after the finishing section is installed in the recessed housing can, in accordance with example embodiments of a prior art.

For example, the plaster frame assembly may be disposed above the lower ceiling 101 such that the base plate rests on and engages the lower ceiling 101 and a can receiving opening of the base plate is axially aligned with a recessed luminaire opening in the ceiling. Then, one or more fasteners, e.g., threaded screws, may be inserted from below the ceiling such that they pass through the ceiling and engage respective perforations of each pad of the base plate to securely retain or fasten the base plate to the ceiling. Once the base plate of the plaster frame assembly is securely retained or fastened to the ceiling using the fasteners, an upward movement of the base plate from its original position as shown in FIGS. 3 and 4 may be eliminated or limited when the finishing section is installed in the recessed housing can retained by the base plate of the plaster frame assembly. Consequently, after the installation of the finishing section in the recessed housing can, when a force with which the finishing section is pushed into the recessed housing can is released, a downward movement of the recessed housing can and/or the base plate to its original position over time is also eliminated or limited, thereby maintaining the trim ring of the finishing section against the ceiling and eliminating the formation or reintroduction of a gap in between the trim ring and the ceiling.

Further, the pads formed in the base plate and having the plurality of perforations are regressed from a remainder of a base wall of the base plate such that, when the base plate is disposed on the lower ceiling 104, a gap is created between a top surface 204 of the lower ceiling 104 and an area of the base plate having the pads. The gap formed between the lower ceiling and the pads formed in the base wall of the base plate is configured to account for a portion of the lower ceiling 104 that may flare out on the top surface 204 of the lower ceiling 104 when fasteners are inserted through the ceiling (and through the perforations in the pads) to securely retain or fasten the base plate to the lower ceiling 104. In particular, the gap formed between the lower ceiling 104 and the pads formed in the base plate receives and accommodates the portion of the lower ceiling that flares out when fasteners are inserted through lower ceiling 104. Hereinafter the pads formed in the base plate and having the plurality of perforations may be referred to as regressed pads.

In addition to the regressed pads, the base plate of the plaster frame assembly includes one or more sealing features that are configured to provide an air-tight seal for the recessed housing can. In particular, the one or more sealing features of the base plate include a collar having multiple collar sections that extend into the can receiving opening of the base plate from at least a portion of the perimeter of the can receiving opening. Each collar section has a curved cross-sectional profile and defines a substantially inverted V-shaped groove. The collar is configured to receive a ring-shaped extruded sealing member having a substantially triangular cross-sectional profile to create an air-tight seal that seals a gap between the ceiling, the base plate of the plaster frame assembly, and a perimeter of the recessed housing can that is received through the can receiving opening. It is noted that other example embodiments where the sealing members and corresponding collars have other geometric or non-geometric cross-sectional profiles are within the broader scope of the present disclosure.

Further, the one of more sealing features of the base plate include multiple elongate sealing tabs that are formed at the perimeter of the can receiving opening of the base plate and disposed between the multiple collar sections. Each elongate sealing tab extends into the can receiving opening with at least a portion of the elongate sealing tab being substantially perpendicular to the base wall of the base plate and extending in a direction opposite to the base wall of the base plate and/or the lower ceiling. Further, each elongate sealing tab includes a coupling aperture. The multiple elongate sealing tabs are configured to assist in guiding and positioning the recessed housing can within the base plate of the plaster frame assembly as the recessed housing can is inserted through the can receiving opening of the base plate. Further, the multiple elongate sealing tabs are configured to create an air-tight seal that seals adjustment slots formed in the side wall of the recessed housing can. For example, the recessed housing can is received through the can receiving opening of the base plate and retained in the base plate such that the adjustment slots formed in the side wall of the recessed housing can aligns with respective elongate sealing tabs of the base plate. Then, a fastener, such as a screw is passed through each adjustment slot of the recessed housing can and a coupling aperture of a respective elongate sealing tab that is aligned with the adjustment slot. As the fastener is tightened, the elongate sealing tab is pulled closer to the adjustment slot to form an air-tight seal that seals the adjustment slots of the recessed housing can.

Any seal between two or more components (or two or more portions of a component) of a luminaire described herein can be an environmental seal. An environmental seal can restrict some or all of a number of elements (e.g., dust, moisture) from penetrating the seal, making the seal "air tight". Such a seal can create a pressurized environment, or the seal can allow some minimal amount of air to pass therethrough.

Moving now to discuss the figures, FIGS. 6-21 will describe one or more example embodiments of a plaster frame assembly having the regressed pads and the sealing features formed therein to: (a) eliminate the formation or reintroduction of a gap in between the trim ring of a finishing section and the ceiling over time after the finishing section is installed in the recessed housing can, and (b) improve an air-tight sealing of the recessed housing can.

Referring to FIGS. 6-21, the example plaster frame assembly 600 may include a base plate 603 and a pair of hanger bars assemblies (601, 602), e.g., a first hanger bar assembly 601 and a second hanger bar assembly 602 that are attached to the base plate 603 at opposite sides of the base plate 603. The hanger bar assemblies (601, 602) may be adjustable in length to attach luminaires, such as recessed luminaires, to support structures that have different spacings between them. Each hanger bar assembly (601 and/or 602) may include attachment members 628 on opposite ends of the hanger bar assembly (601 and/or 602) that are configured to secure the hanger bar assembly (601 and/or 602) to a support structure, such as parallel joists, suspended ceiling T-grids, and/or steel framing, using respective fasteners 630 (e.g., a screw or nail).

Figure 6:
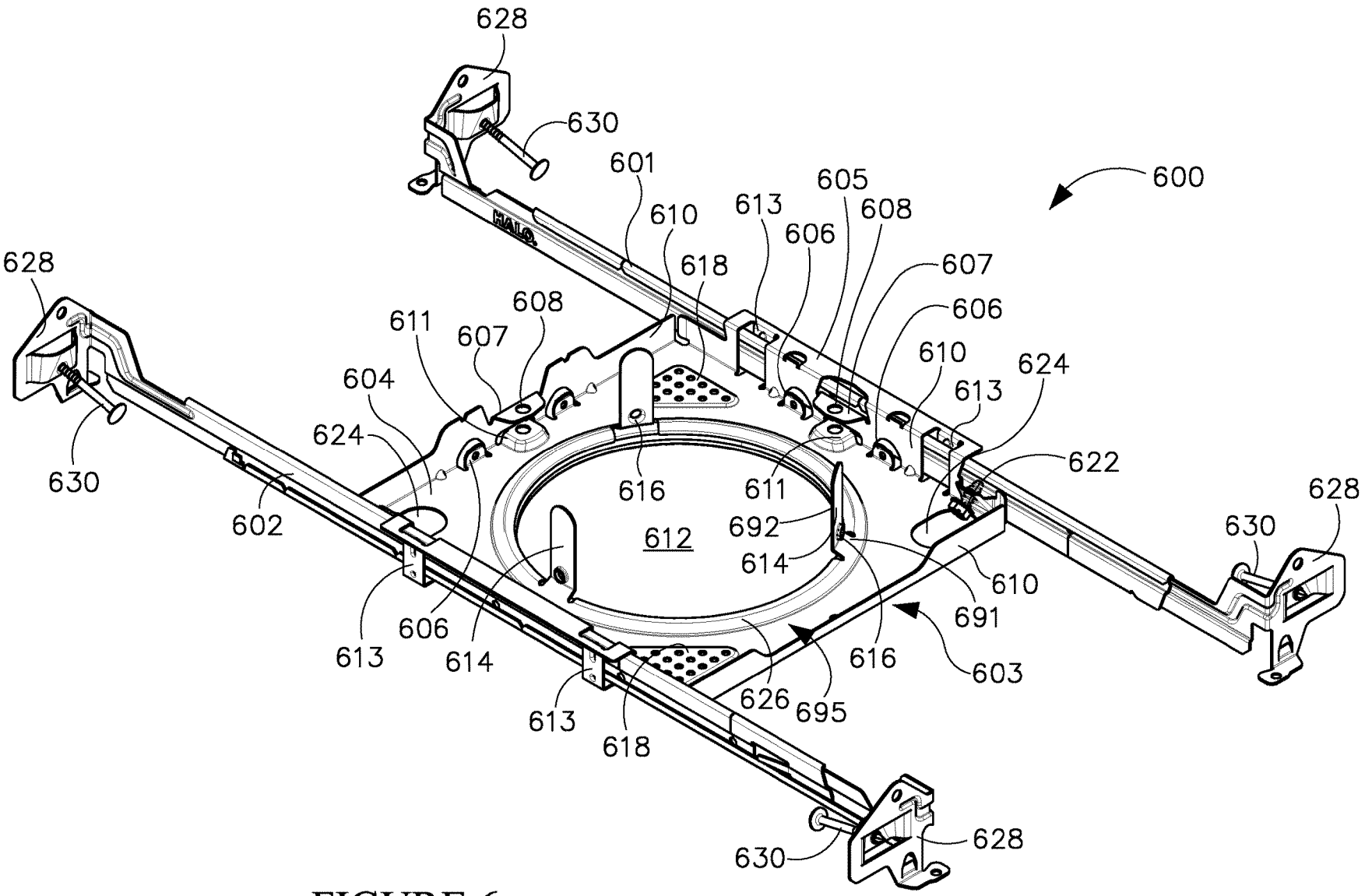
FIG. 6 illustrates a perspective view of an example plaster frame assembly for recessed luminaires, in accordance with example embodiments of the present disclosure.
Figure 7:
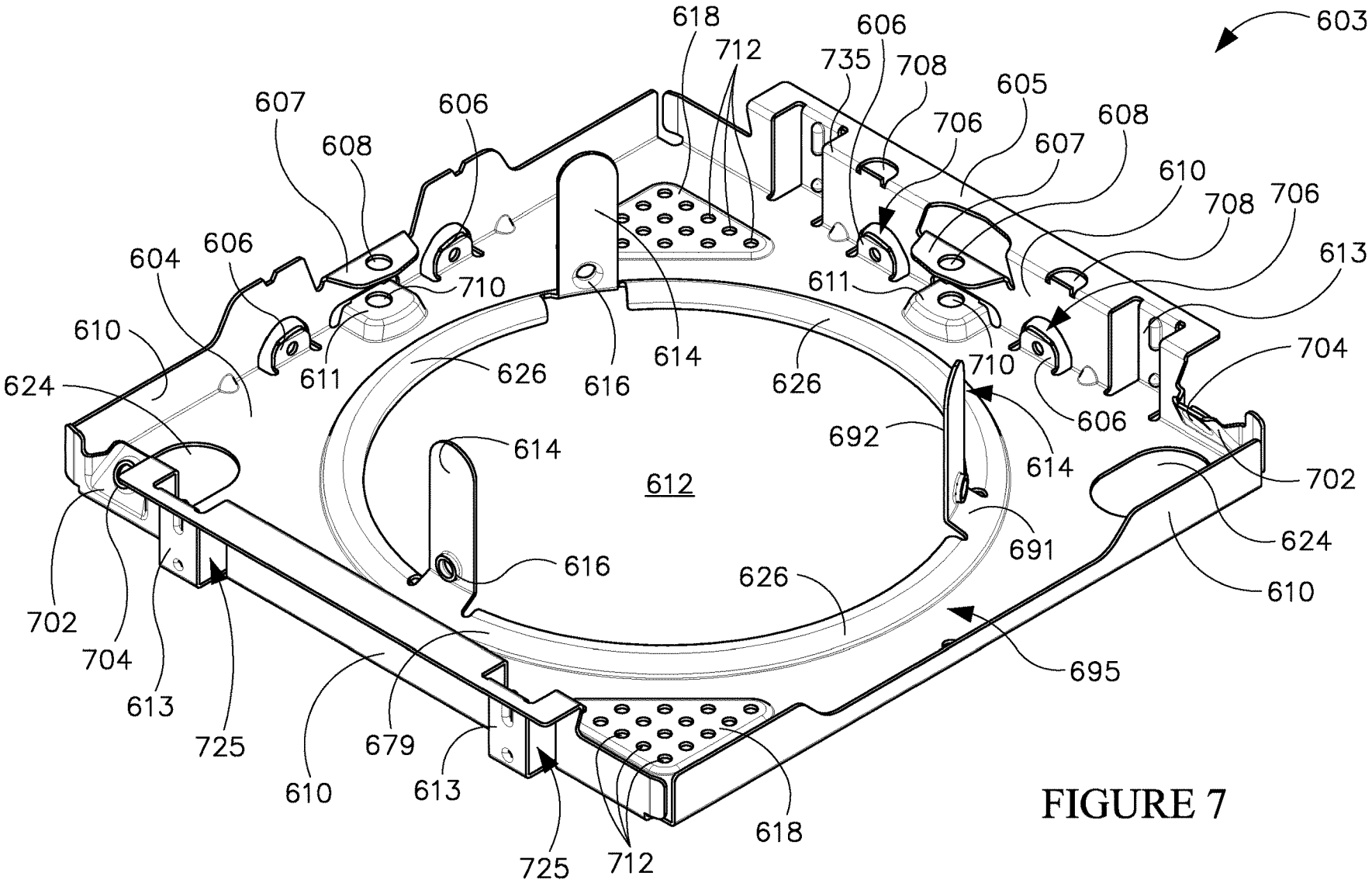
FIG. 7 illustrates a perspective view of an example base plate of the plaster frame assembly illustrated in FIG. 6, in accordance with example embodiments of the present disclosure.

The base plate 603 may include one or more attachment tabs 613 that are formed on opposite sides of the base plate 603 to receive and attach the hanger bar assemblies (601, 602) to the base plate 603. In one example embodiment, as illustrated in FIGS. 6-9, 11, 13-17 and 19, each of the attachment tabs 613 may form a loop with a respective side wall 610 of the base plate 603, where the loop defines a hanger bar receiving opening 725 (shown in FIG. 7) that is configured to receive the hanger bar assembly (601 and/or 602) therethrough. As illustrated in FIG. 6, the first hanger bar assembly 601 may be slidably received through the hanger bar receiving openings 725 defined by a first pair of attachment tabs 613 formed on one side of the base plate 613, and similarly, the second hanger bar assembly 602 may be slidably received through the hanger bar receiving openings 725 of a second pair of attachment tabs 613 formed on an opposite side of the base plate 613.

In some example embodiments, the attachment tabs 613 may be integrally formed with the base plate 603, for example, the attachment tabs 613 may formed from portions of the side wall 610 or mating flange 605 of the base plate 603. In other example embodiments, the attachment tabs 613 may be removably coupled to or attached to the base plate 603, for example, by soldering or using fasteners. Further, the attachment tabs 613 may be elastic and movable in some example embodiments.

In addition to the attachment tabs 613, the base plate 603 may include a substantially square shaped base wall 604 with side walls 610 extending substantially perpendicular to the base wall 604 along the perimeter of the base wall 604. It is noted that other example embodiments where the base wall 604 has any other appropriate geometric or non-geometric shape is within the broader scope of the present disclosure. Further, other example embodiments where the side walls extend from other portions of the base wall or a portion of the base wall perimeter at a different angle to the base wall is also within the broader scope of the present disclosure.

Figure 13:
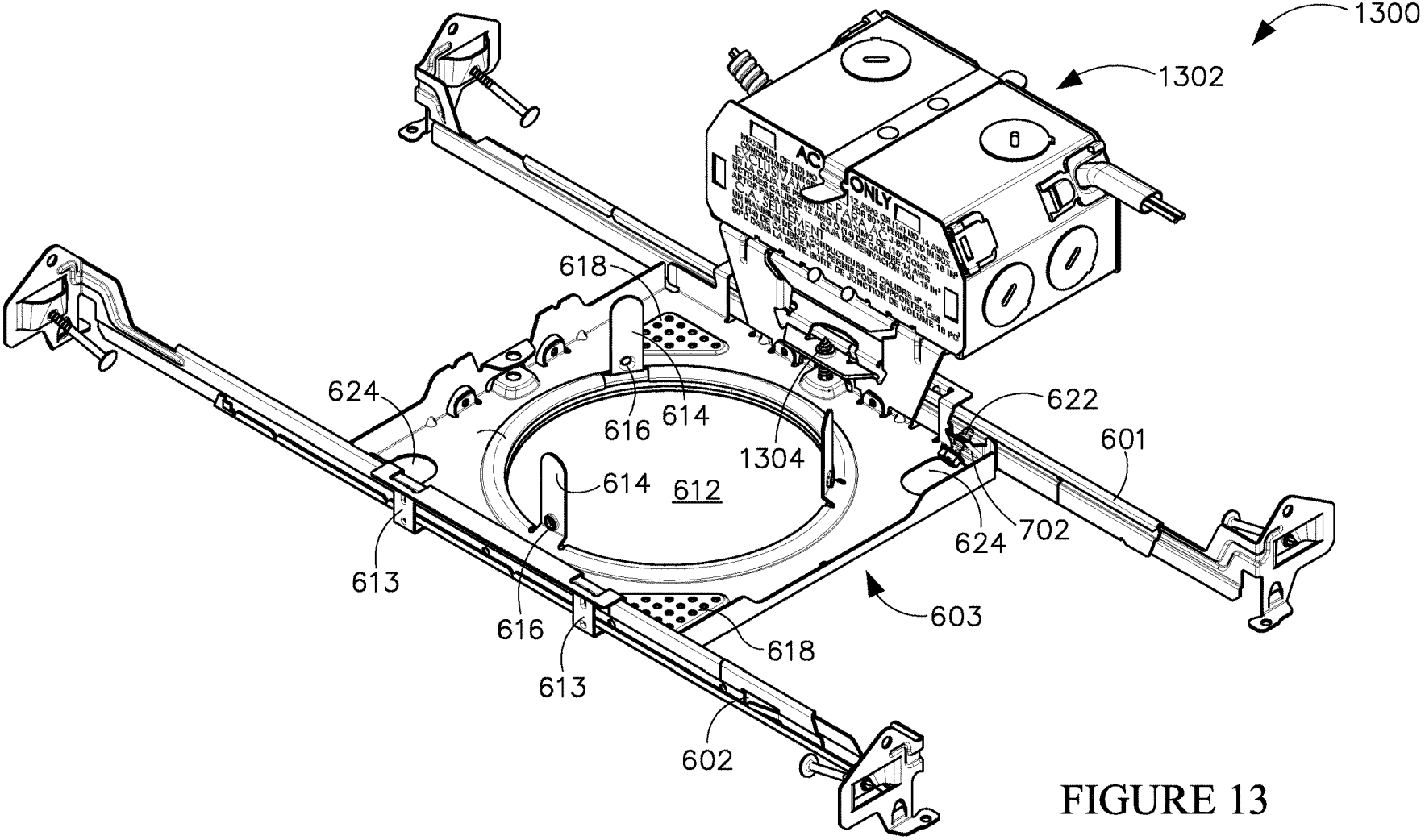
FIG. 13 illustrates a perspective view of the plaster frame assembly with a junction box attached thereto, in accordance with example embodiments of the present disclosure.

One or more of the side walls 610 may include one or more coupling and mating features formed therein to receive and attach a junction box 1302 to the base plate 603 of the plaster frame assembly 600 as illustrated in FIG. 13. The one or more coupling and mating features may include a mating flange 605 that extends substantially perpendicular to the side wall 610 and substantially parallel to the base wall 604 from a top edge of the 735 (shown in FIG. 7) of the side wall 610. In particular, the mating flange 605 extends outward from the side wall 610 in a direction that is away from and opposite to the base wall 604. The mating flange 605 may include a first pair of mating apertures 708 (shown in FIG. 7) formed therein to receive corresponding mating features of the junction box 1302.

Further, the coupling and mating features formed in one or more of the side walls 610 may include a coupling tab 607 that is formed from a portion of the side wall 610 and extends substantially perpendicular to the side wall 610 and substantially parallel to the base wall 604. The coupling tab 610 may extend inwards towards the base wall 604 and may include a coupling aperture 608 to receive a fastener 1304, such as a screw therethrough to couple the junction box 1302 to the base plate 603 of the plaster frame assembly as illustrated in FIG. 13. The coupling tab 607 may be disposed in between the first pair of mating apertures 708 formed in the mating flange 605. Furthermore, the coupling and mating features formed in one or more of the side walls 610 of the base plate 603 may include a second set of mating openings 706 (shown in FIG. 7) that are configured to receive complementary mating features of the junction box 1302 when the junction box 1302 is coupled to the base plate 603 of the plaster frame assembly 600.

In addition to the coupling and mating features formed in one or more of the side walls 610 of the base plate 603, the base wall 604 may also include one or more coupling and mating features. The coupling and mating features formed in the base wall 604 of the base plate 603 may include a regressed coupling structure 611 having an aperture 710. The regressed coupling structure 611 and the aperture 710 may be formed below the coupling tab 607 such that the coupling aperture 608 of the coupling tab 607 is axially aligned with the aperture 710 of the regressed coupling feature 611 formed in the base wall 604 of the base plate 603. Further, the coupling and mating features formed in the base wall 604 of the base plate 603 may include a pair of vertical tabs 606 extending substantially perpendicular to the base wall 604 of the base plate 604 and substantially parallel to the side wall 610. The pair of vertical tabs 606 may be disposed on either side of the regressed coupling structure 611.

In one or more example embodiments, the coupling and mating features of the base wall 604 and the one or more side walls 610 may form vertical and/or horizontal boundaries for the coupling features of the junction box 1302. In certain example embodiments, the coupling and mounting features may receive (slidably couple to) the complementary coupling features of the junction box 1302 when the junction box 1302 is mechanically coupled to the base plate 603. The coupling and mating features can prevent the coupling features (and, thus, the rest of the junction box 1302) from moving further downward toward and/or rotating from a vertical position with respect to the base plate 603. The coupling and mating features can include one or more features (e.g., apertures, detents, a stepped configuration) to directly or indirectly couple the junction box 1302 to the base plate 603.

In addition to the coupling and mating features, the base plate 603 may include a locking tab 702 that is formed on opposite side walls 610 of the base plate 603. Each locking tab 702 may be integral to the side wall 610 and may extend inwards from the side wall 610 towards the opposite side wall 610. Further, each locking tab 702 may slope upward at an angle to the side wall 610 (e.g., acute angle to the side wall 610). Further, each locking tab 702 may include an aperture 704 that is configured to receive a locking fastener 622, such as a threaded screw, therethrough to tighten the coupling between the base plate 603 and the hanger bars assemblies (601, 602) and prevent further sliding movement of the base plate 603 along the hanger bar assemblies (601, 602).

For example, as illustrated in FIGS. 6, 9-16 and 18, each locking fastener 622 may be passed through the aperture 704 of the respective locking tab 702 such that the tip of the locking fastener 622 (e.g., screw) engages the respective hanger bar assembly (601 or 602) to lock the base plate 603 to the hanger bar assembly (601 and 602) and to prevent any unnecessary sliding movement of the base plate 603 along the hanger bar assemblies (601, 602) (herein interchangeably referred to as 'hanger bars'). As the locking fastener 622 is tightened, the coupling between the base plate 603 and the hanger bars (601, 602) are tightened and the base plate 603 may be locked in place along the hanger bars (601, 602).

Figure 10:
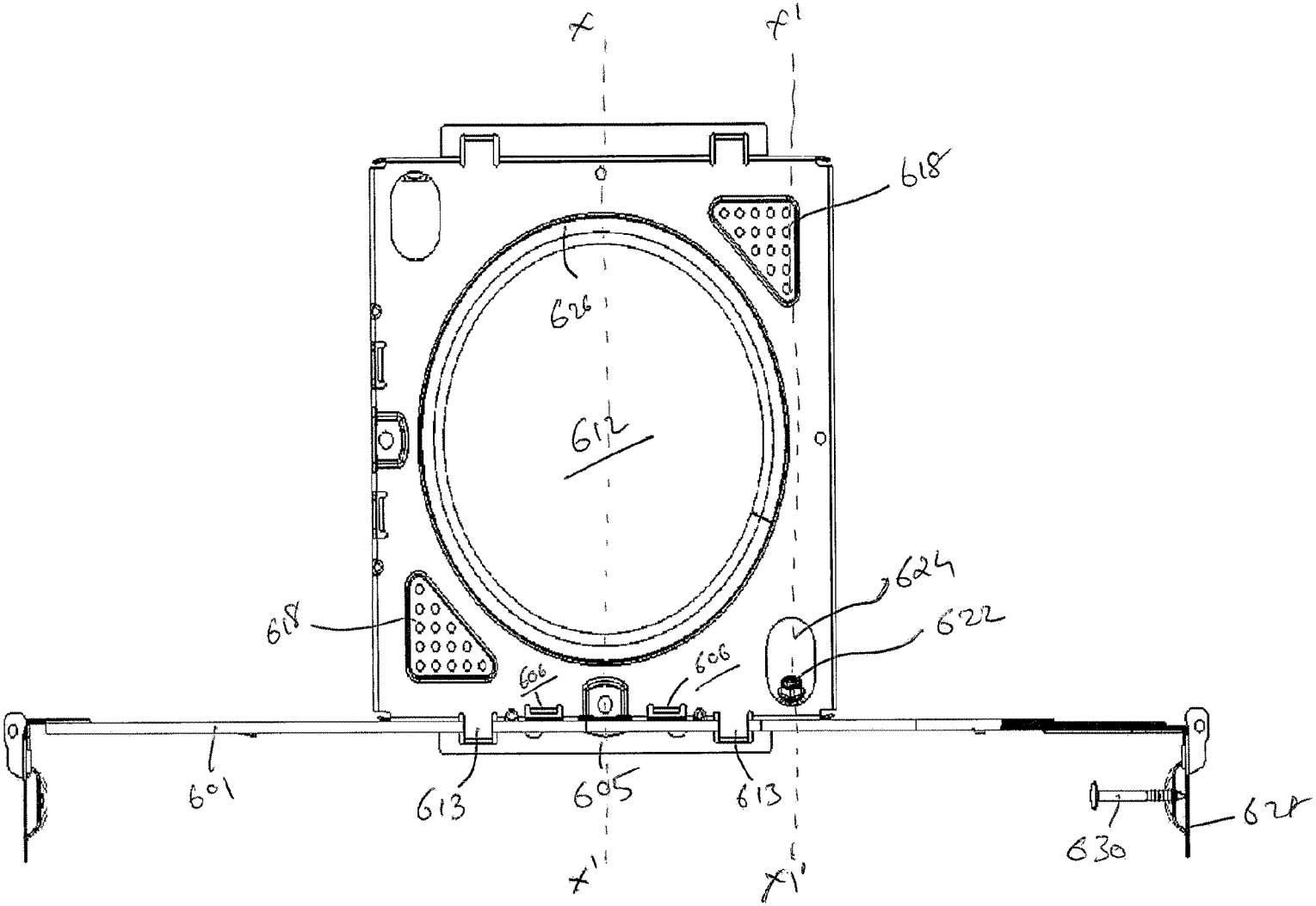
FIG. 10 illustrates a bottom view of the base plate and the hanger bar assembly illustrated in FIG. 9, in accordance with example embodiments of the present disclosure.

The base wall 604 may include an access opening 624 formed therein below each locking tab 702. In particular, the access openings 624 may be formed adjacent opposite corners of the base wall 604 and below each locking tab 702 to allow a user to easily access the locking fastener 622 disposed in the aperture 704 of the locking tab 702 from underneath the plaster frame assembly 600 as illustrated in FIG. 10. For example, once the hanger bars (601, 602) that support the base plate 603 are attached to the joists 101, a user may slide the base plate 603 along the hanger bars (601, 602) to position a can receiving opening 612 of the base plate 603 as desired. Then, the user may access each locking tab 702 of the base plate 603 via the respective access openings 624 to insert a locking fastener 622 (e.g., threaded screw) through the locking tabs 702. Once the locking fasteners 622 are tightened and engage the respective hanger bars (601, 602), the base plate 603 may be locked such that any further sliding movement of the base plate 603 along the hanger bars 601 and 602 is prevented. If the user wants to readjust the position of the base plate 603 along the hanger bars 601 and 602 to a new desired position, the user may have to unscrew or loosen the locking fastener 622, slide the base plate 603 to the new desired position along the hanger bars (601, 602), and then tighten the locking fasteners to hold it in the new desired position.

Figure 8:
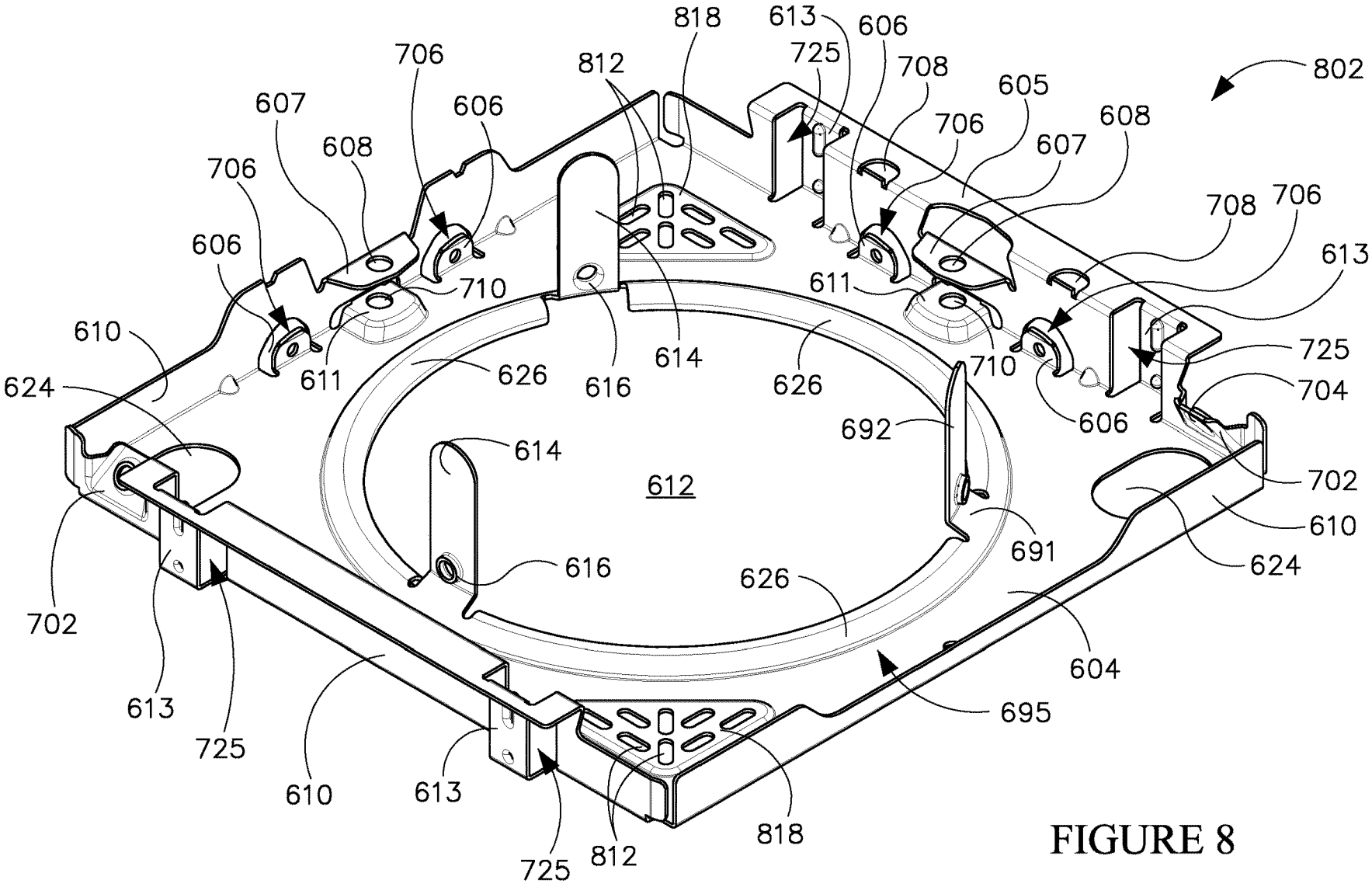
FIG. 8 illustrates a perspective view of another example base plate, in accordance with example embodiments of the present disclosure.
Figure 9:
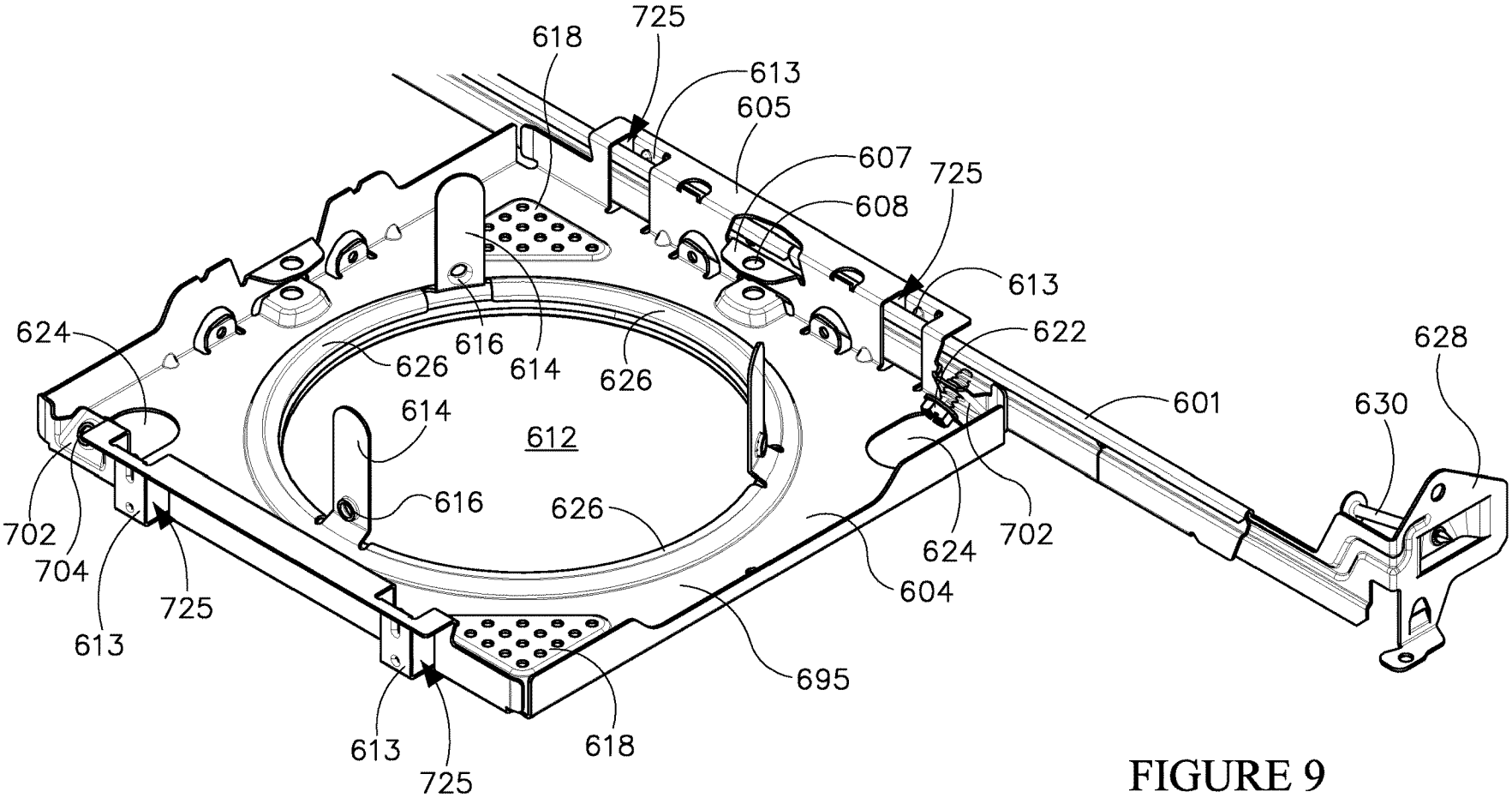
FIG. 9 illustrates a perspective view of the base plate of FIG. 6 with one hanger bar assembly attached to the base plate, in accordance with example embodiments of the present disclosure.

In addition to the coupling and mating features (605, 606, 607, 608, 611, 706, 708, and 710) and the locking tab 702, the base wall 604 may include regressed pads 618 formed in the base wall 604 adjacent opposite corners of the base plate 603. Each regressed pad 618 may include a plurality of uniform or non-uniform perforations (shown in FIG. 7) that are formed therein. The regressed pads 618 may be a portion of the base wall 604 that is raised from a remainder portion of the base wall 604 as illustrated in FIGS. 6-10 and 12-19. Further, as illustrated in FIGS. 6-10 and 12-19, the regressed pads 618 may be substantially triangular in shape. However, it is noted that in other example embodiments, the regressed pads may have any other appropriate geometric or non-geometric shape without departing from a broader scope of the present disclosure. In one example embodiment, the plurality of perforations may be circular through holes 712 as illustrated in FIGS. 6-7, 9-10 and 12-19. However, in other example embodiments, the perforations may be through openings having any other appropriate shape without departing from a broader scope of the present disclosure. For example, as illustrated in FIG. 8, the plurality of perforations may be elongated through slots 812.

In some example embodiments, the plurality of perforations may include different shapes within the same regressed pad 618, e.g., the regressed pad 618 may include a mix of circular holes, elongated slots, etc., of different sizes. Alternatively, one regressed pad 618 may include a plurality of circular holes 712, while the opposite regressed pad 618 may include a plurality of elongated slots 812.

Figure 16:
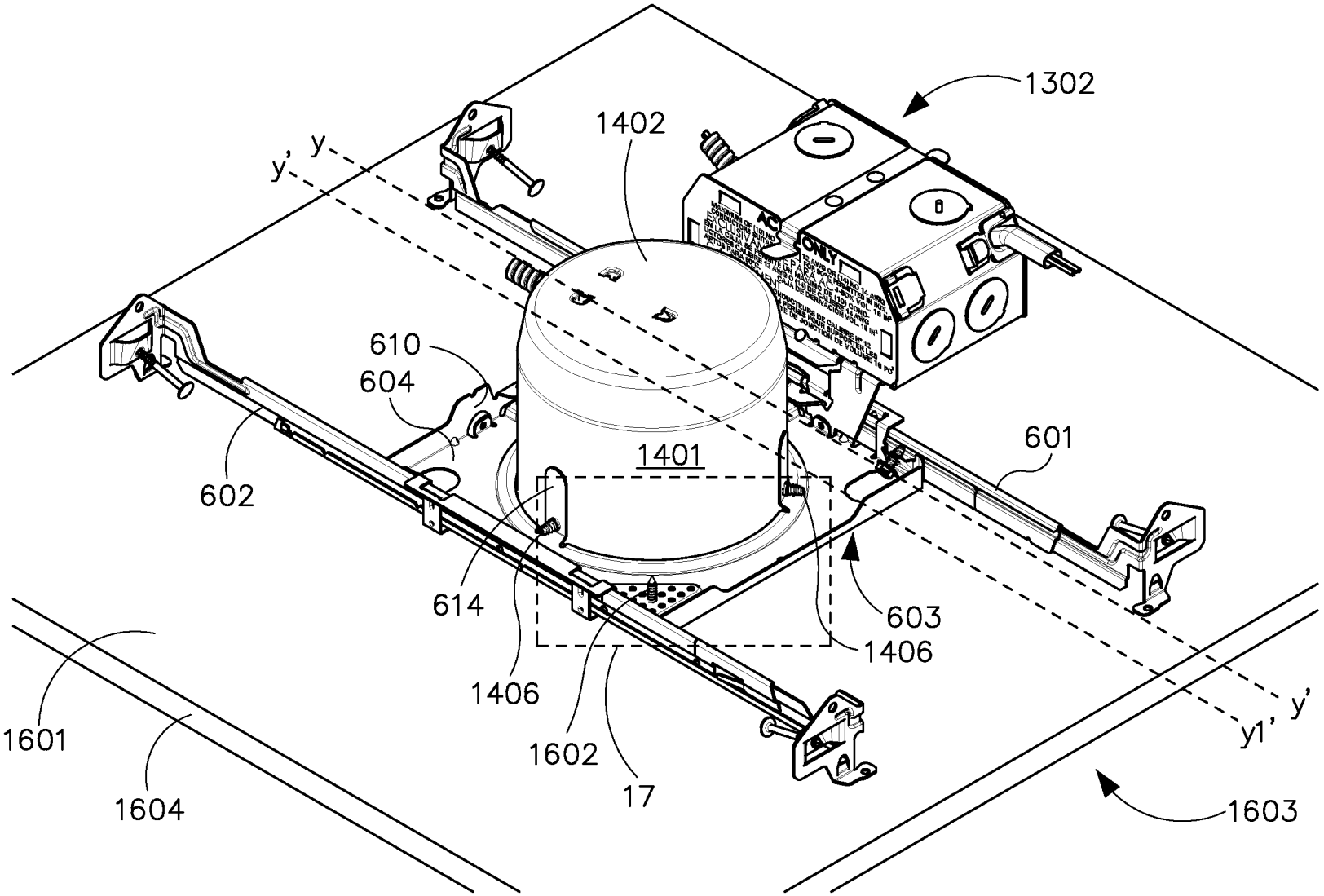
FIG. 16 illustrates a perspective view of the plaster frame assembly being secured to the lower ceiling using fasteners, in accordance with example embodiments of the present disclosure.
Figure 17:
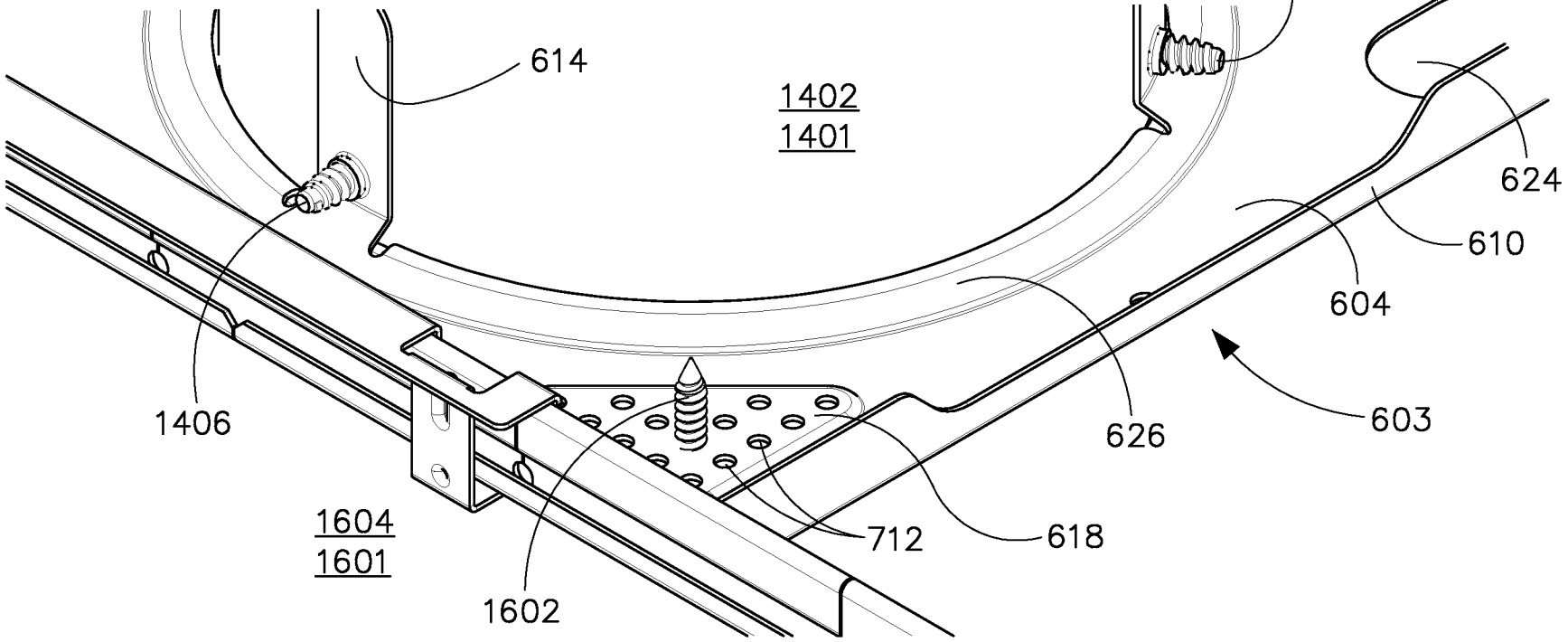
FIG. 17 illustrates an enlarged view of a portion of the plaster frame assembly where the plaster frame is secured to the lower ceiling using the fasteners, in accordance with example embodiments of the present disclosure.
Figure 18:
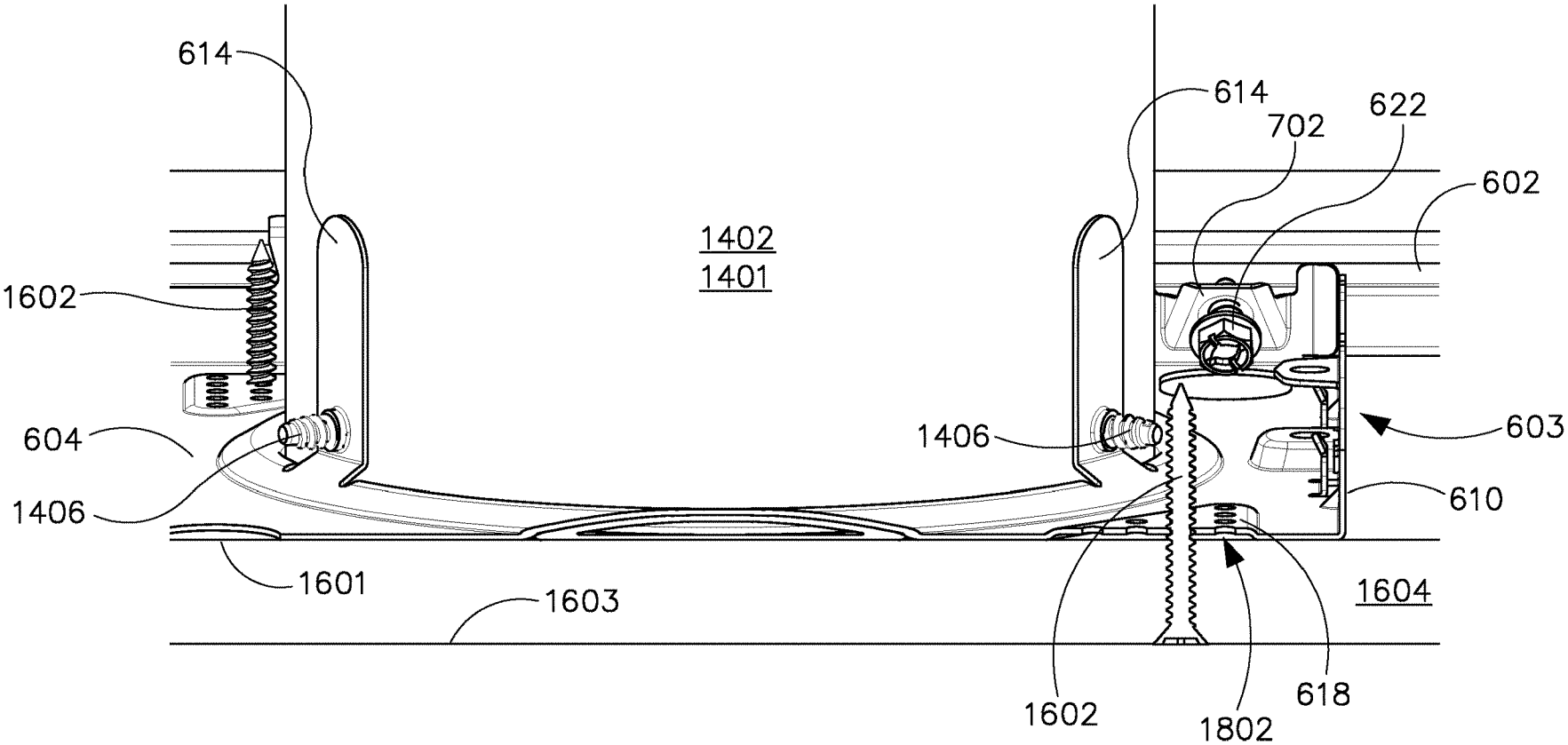
FIG. 18 illustrates a cross sectional view of the plaster frame assembly with the recessed housing can attached thereto as illustrated in FIG. 16 along a Y-Y' axis, in accordance with example embodiments of the present disclosure.

As illustrated in FIGS. 16-18, the perforations 712 (or 812) in each regressed pad 618 may be configured to receive one or more securing fasteners 1602 therethrough to securely retain and fasten the base plate 603 of the plaster frame assembly 600 to the ceiling 1604. In some embodiments, a regressed pad 618 having the circular holes 712 may be preferred, whereas in other embodiments, a regressed pad 818 having the elongated slots 812 may be preferred. The elongated slots 812 may provide an aperture having a larger area for receiving the securing fastener 1602 therethrough as compared to the circular holes 712.

Figure 20:
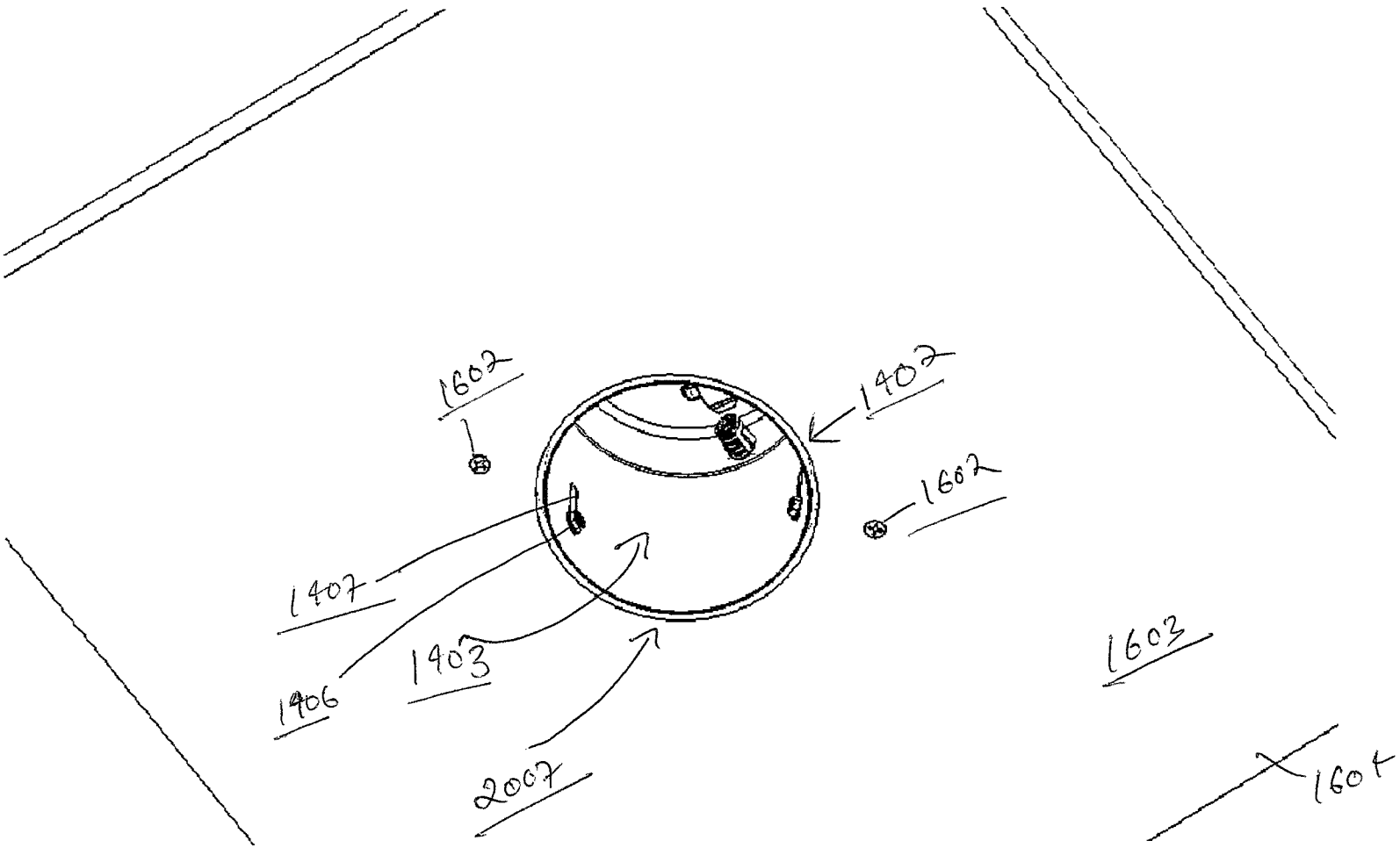
FIG. 20 illustrates a bottom perspective view of the ceiling after the recessed housing can is mounted in the ceiling using the plaster frame assembly and the plaster frame assembly is secured to the ceiling using fasteners, in accordance with example embodiments of the present disclosure.
Figure 21:
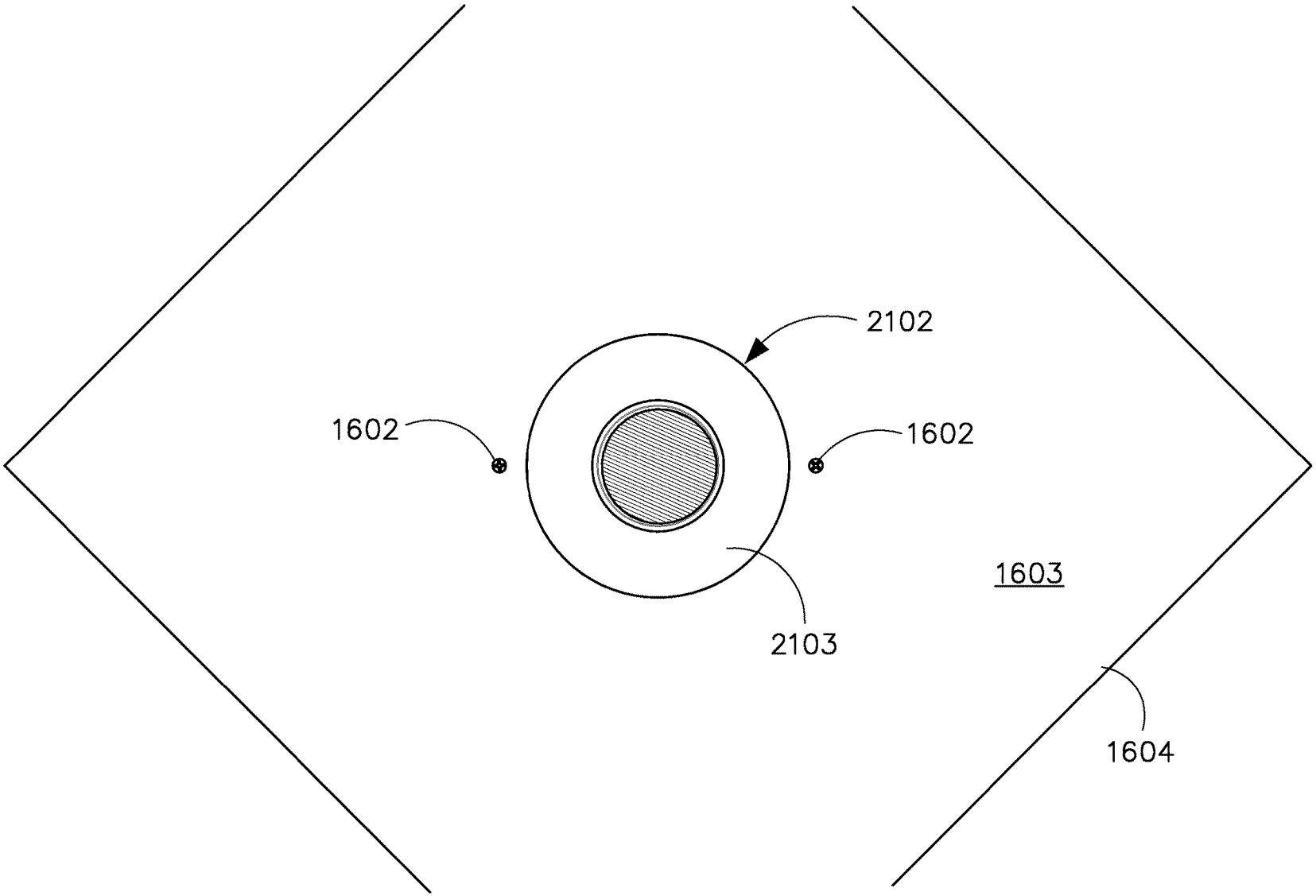
FIG. 21 illustrates a bottom perspective view of the ceiling after a finishing section is installed in the recessed housing can mounted in the ceiling using the plaster frame assembly that is secured to the ceiling using fasteners, in accordance with example embodiments of the present disclosure.

In particular, to secure the plaster frame assembly 600 to the ceiling 1604, initially, the hanger bars 601 and 602 of the plaster frame assembly 600 may be coupled to the support structures such that the base plate 603 and the recessed housing can 1402 retained by the base plate 603 may be disposed in a space above the top surface 1601 of the ceiling 1602. Further, one or more securing fasteners 1602, e.g., threaded screws, may be positioned below the bottom surface 1603 of the ceiling 1604 and in axial alignment with the perforations 712 (or 812) of each of the regressed pads 618. Then, the one or more securing fasteners 1602 are inserted through the ceiling 1604 such that the securing fasteners 1602 enter the ceiling 1604 through the bottom surface 1603 of the ceiling, exit through the top surface 1601 of the ceiling 1604, and subsequently pass through a respective perforation 712 (or 812) in the regressed pads 618 to securely retain and/or fasten the base plate 603 to the ceiling 1604. Securely retaining and/or fastening the base plate 603 to the ceiling 1604 may eliminate the formation or reintroduction of a gap in between the trim ring 2103 of a finishing section 2102 and the ceiling 1604 over time after the finishing section 2102 (shown in FIG. 21) is installed in the recessed housing can 1402 retained by the base plate 603. FIG. 20 illustrates a view of the bottom surface 1603 of the ceiling 1604 (view as seen by a user from a room in which the plaster frame and recessed luminaire is installed) when the base plate 603 is fastened to the ceiling 1604. As shown in FIG. 20, the securing fasteners 1602 may be inserted through the ceiling to engage a respective perforation 712 (or 812) and till the head of the securing fasteners 1602 are flush with the bottom surface 1603 of the ceiling 1604. Accordingly, a portion of the securing fasteners 1602, e.g., head, may be visible to a user looking from underneath the ceiling 1604 once the base plate 603 is secured to the ceiling 1604 using the securing fasteners 1602. However, plaster may be applied over the ceiling 1602 to hide the visible portion of the securing fasteners 1602 and to provide a smooth and finished ceiling surface. Further, FIG. 21 illustrates a view of the unfinished bottom surface 1603 of the ceiling 1604 when the finishing section 2102 is installed in the recessed housing can 1402 such that the trim flange 2103 of the finishing section 2102 covers a gap that exists between the ceiling 1604 and the recessed housing can 1402.

As illustrated in FIG. 18, when the base plate 602 is disposed on the ceiling 1604, the regressed pads 618 of the base plate 603 that are raised above a remainder portion of the base wall 604 may form a gap 1802 between the regressed pad 618 and the top surface 1601 of the ceiling 1604. The gap 1802 may be configured to account for and receive a portion of the ceiling that may flare out at the top surface 1601 where the securing fastener 1602 exits the ceiling 1604 when the securing fastener 1602 is inserted through the ceiling 1604 to securely retain the base plate 603 to the ceiling 1604.

Figure 11:
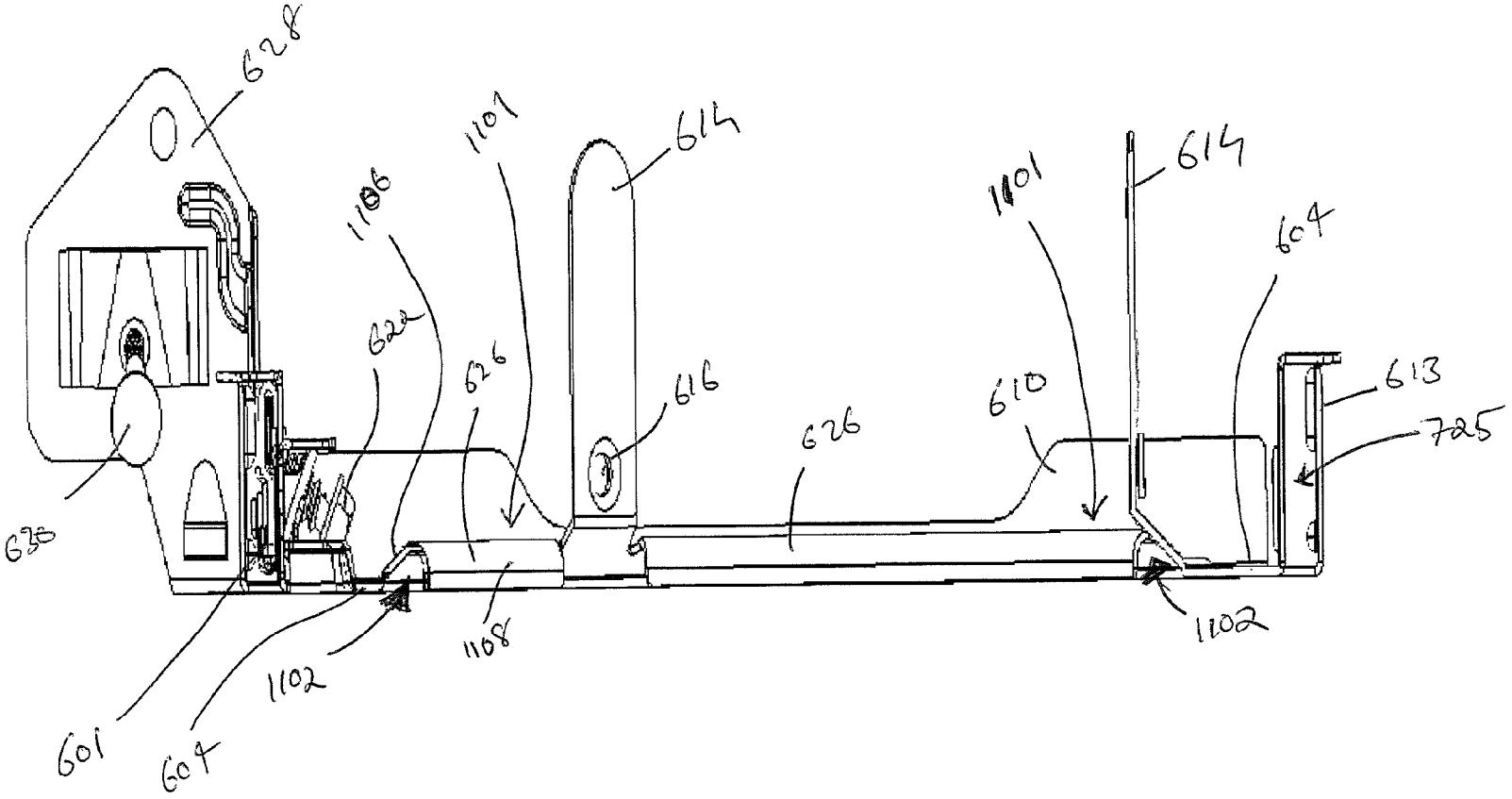
FIG. 11 illustrates a cross section view of the base plate and the hanger bar illustrated in FIG. 10 along an X-X' axis, in accordance with example embodiments of the present disclosure.
Figure 12:
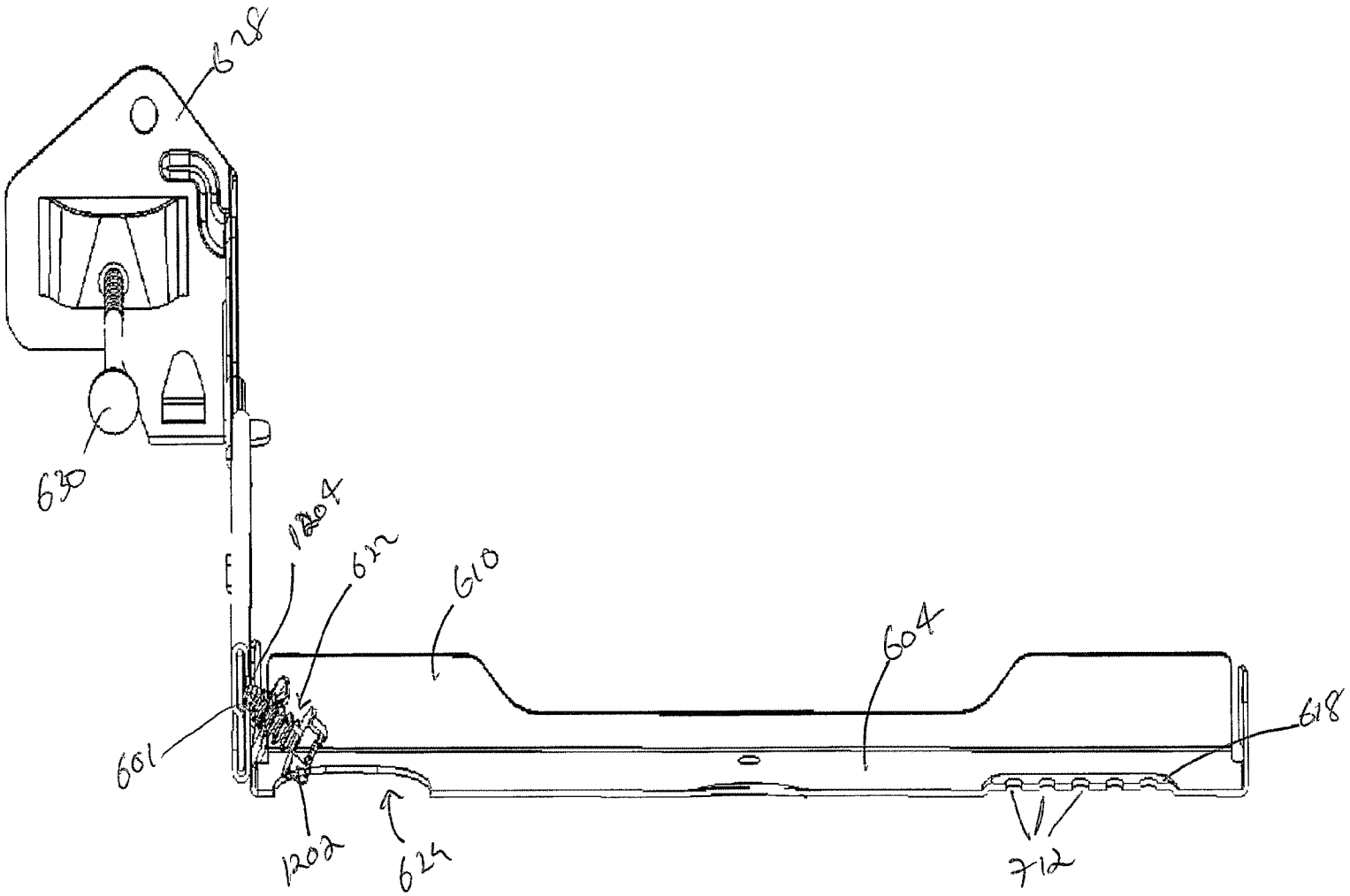
FIG. 12 illustrates a cross section view of the base plate and the hanger bar assembly illustrated in FIG. 10 along an X1-X1' axis, in accordance with example embodiments of the present disclosure.

In addition to the regressed pads 618, the base wall 604 of the base plate 603 may include a plurality of sealing features to improve an air-tight sealing of a recessed housing can 1402 retained by the base plate 603. In particular, the plurality of sealing features may include a collar 695 (shown in FIG. 6) that is disposed at a perimeter of a can receiving opening 612 (shown in FIG. 6) that is formed in the base wall 604 of the base plate 603. The can receiving opening 612 may be configured to receive a recessed housing can 1402 therethrough. The collar 695 may have multiple collar sections 626 that extend inward towards the can receiving opening 612 from at least a portion of the perimeter of the can receiving opening 612. It is noted that the perimeter of the can receiving opening 612 may refer to an edge of base wall 604 that defines the can receiving opening 612. In particular, each collar section 626 may have a substantially V-shaped cross-sectional profile that is defined by a curved wall 1101 as illustrated in FIG. 11. The curved wall 1101 may include a first portion 1106 and a second portion 1108. The first portion 1106 may extend upwards in a slope and inward towards the can receiving opening 612 from a perimeter of the can receiving opening 612 such that the first portion 1106 forms an obtuse angle with the base wall 604. Further, the second portion 1108 may further extend downward from an edge of the first portion 1106 into the can receiving opening 612 and substantially perpendicular to the can receiving opening 612 (or a plane that is parallel to the base wall 604).

Figure 14A:
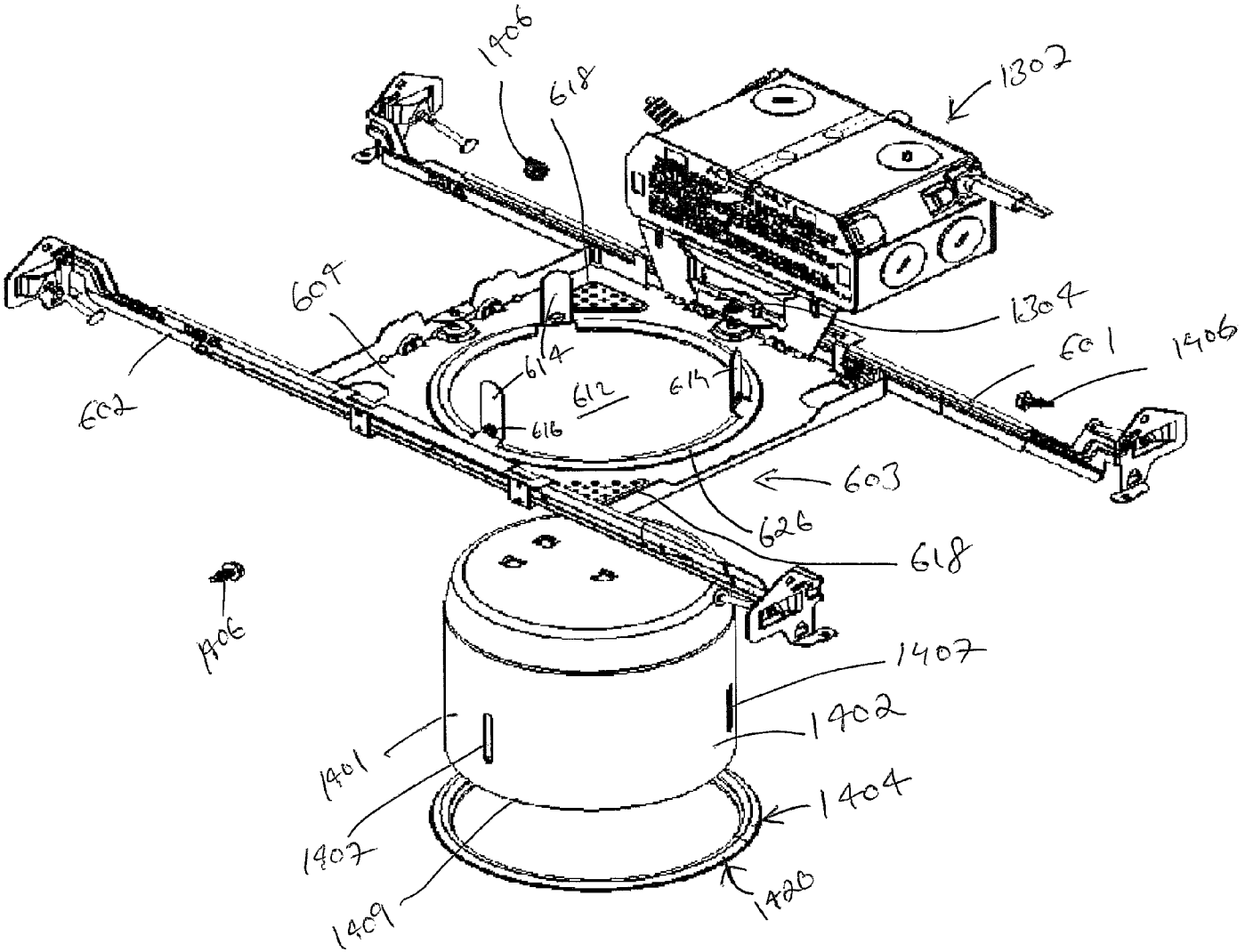
FIG. 14A illustrates an exploded view of the plaster frame assembly with a junction box attached thereto along with a housing can and sealing member, in accordance with example embodiments of the present disclosure.
Figure 14B:
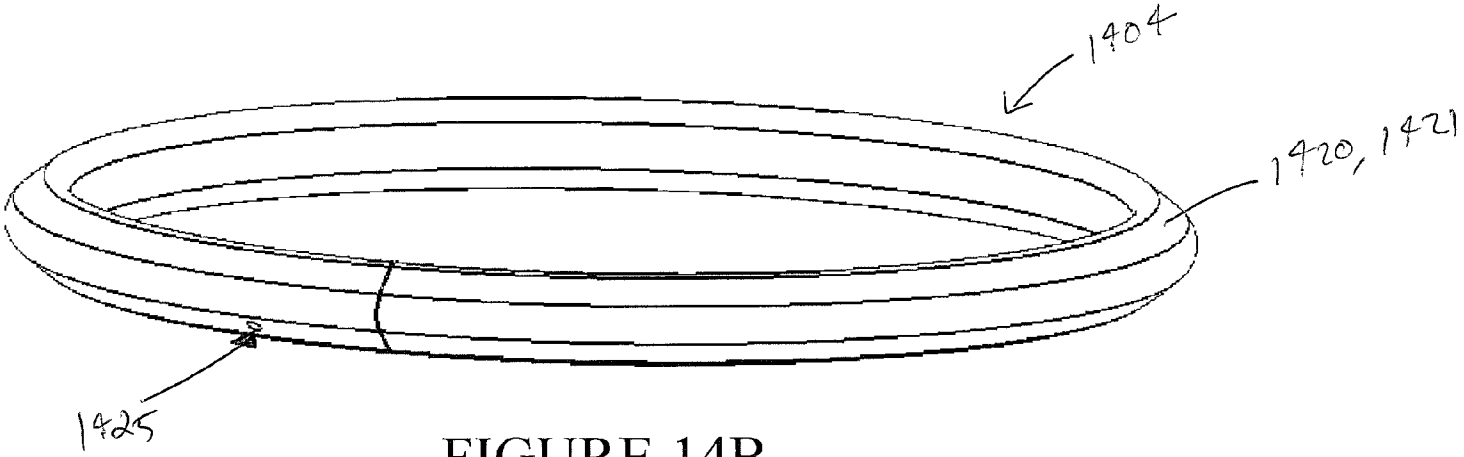
FIGS. 14B and 14C illustrate a perspective view and a cross-section view of the sealing member, respectively, in accordance with example embodiments of the present disclosure.
Figure 14C:
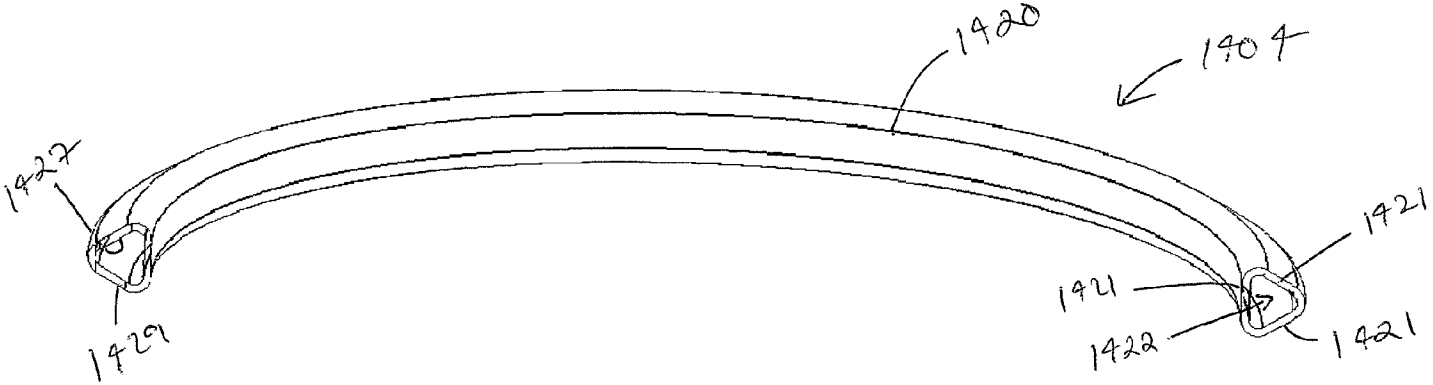
Figure 19:
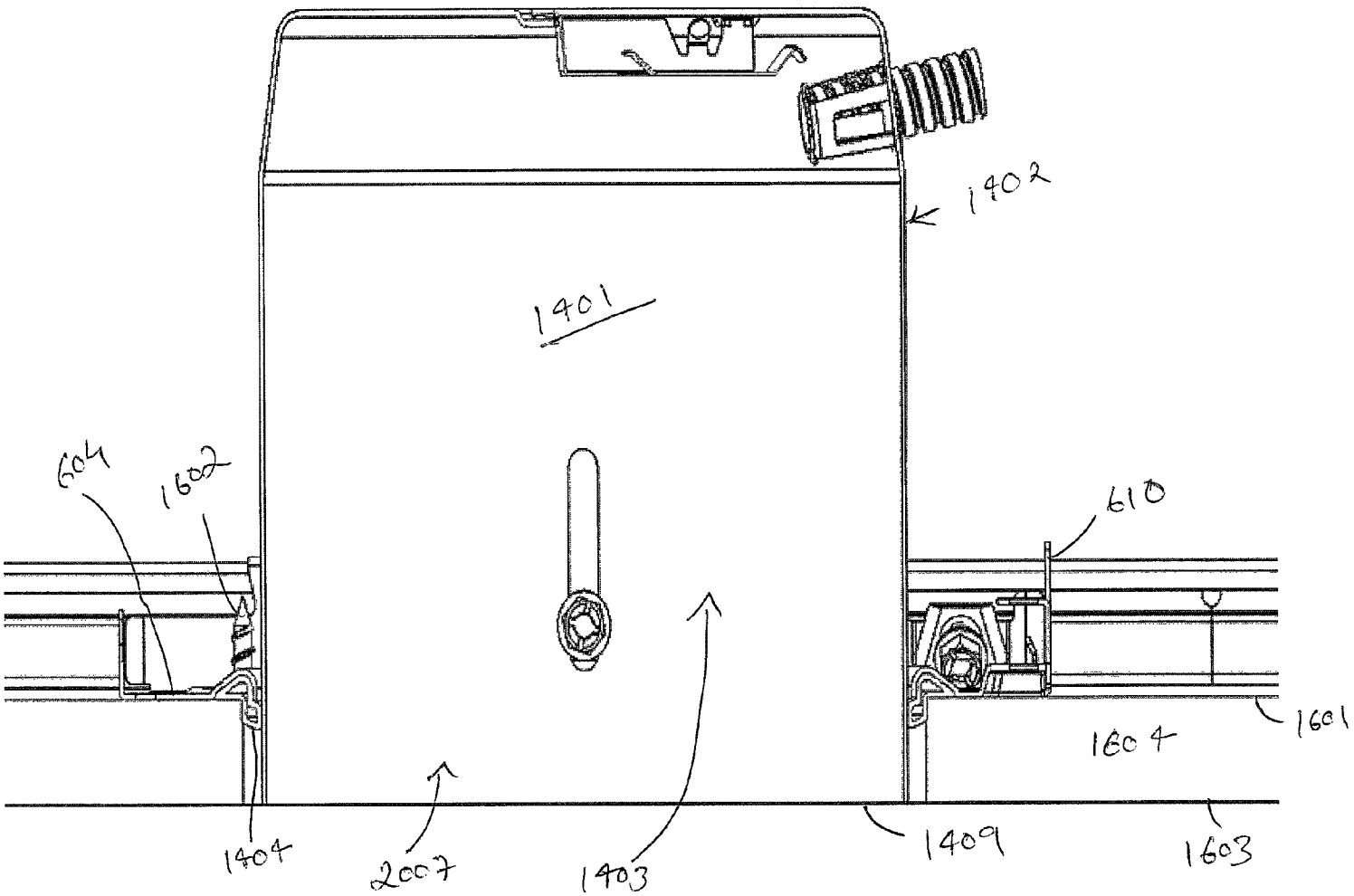
FIG. 19 illustrates a cross sectional view of the plaster frame assembly with the recessed housing can attached thereto as illustrated in FIG. 16 along a Y1-Y1' axis, in accordance with example embodiments of the present disclosure.

Further, as illustrated in FIG. 11, the curved walls 1101 of the multiple collar sections 626 may define a substantially annular groove 1102 that has a substantially V-shaped cross-sectional profile (herein 'V-shaped groove 1102'). As illustrated in FIGS. 14A, 14B, and 19, the V-shaped groove 1102 that is defined by the multiple collar sections 626 may be configured to receive an annular sealing member 1404 having a substantially triangular cross-sectional profile such that the sealing member 1404 is disposed around a perimeter of a side surface of the recessed housing can 1402 to seal a gap between the recessed housing can 1402, the ceiling 1604, and the base plate 603 of the plaster frame assembly 600. Even though the present disclosure describes a collar section that defines a substantially V-shaped groove and a sealing member having a substantially triangular cross-sectional profile, one of ordinary skill in the art can understand and appreciate that in other example embodiments, the groove defined by the collar sections and the cross-sectional profile of the sealing member may have any other appropriate geometric or non-geometric shapes without departing from a broader scope of the present disclosure. For example, in other embodiments, the sealing member can have a substantially circular, oval, or square cross-sectional profile.

The sealing member 1404 of can be made of any one or more of a number of flexible and/or resilient materials, including but not limited to an elastomeric, rubber, silicone, etc. The example sealing member 1404 may have one or more of a number of components. For example, as shown in FIG. 14B, the sealing member 1404 can include a body 1420 that is substantially continuous. In other words, the body 1420 of the sealing member 1404 can form a single piece that has no end. Alternatively, the sealing member 1404 can have two ends that abut against each other when the sealing member 1404 is disposed in the groove 1102 defined by the collar 695 of the base plate 603. In such a case, the sealing member 1404 can be cut to a length that is substantially the same as the length of the groove 1102 in which the sealing member 1404 is disposed.

The body 1420 of the sealing member 1404, when viewed from above, can form any of a number of shapes when in a natural state, such as, but not limited to, a ring (as shown in FIGS. 14A and 14B), an oval, a square, a triangle, a rectangle, or a random shape. Further, the body 1420 of the sealing member 1404 may form a cavity 1422 that is fully or substantially fully enclosed by the body 1420. In certain example embodiments, the body 1420 has at least one wall that forms the cavity 1422 that is fully or substantially fully enclosed by the at least one wall. The cavity 1422 can have any of a number of shapes when viewed cross-sectionally and when the body 1420 is in a natural state. Examples of such shapes of the cavity 1422 can include, but are not limited to, a triangle, a circle, an oval, a square, and a random shape. In the example embodiment illustrated in FIGS. 14A and 14B, the body 1420 of the sealing member 1404 has three walls 1421 that form a closed cavity 1422 in the shape of a triangle.

The body 1420 of the sealing member 1404 has an inner perimeter 1427 and an outer perimeter 1429. The size of the outer perimeter 1429 can be larger than or equal to the size of the recessed housing can 1402 defined by the outer surface of the recessed housing can 1402 such that the sealing member 1404 can be disposed around a perimeter of the recessed housing can 1402. In particular, as illustrated in FIG. 19, the outer perimeter 1429 of the sealing member 1404 may abut against at least a portion of the outer surface of the recessed housing can 1402, the inner surface of the collar sections 626 in the base wall 604 of the base plate 603, and a portion of the ceiling 1604 to form an air-tight seal between the recessed housing can 1402, the ceiling 1604, and the base plate 603 of the plaster frame assembly 600.

In certain example embodiments, the body 1420 of a sealing member 1404 can include one or more features that allow the shape of the cavity 1422 to change (as when the sealing member 1404 is under compression) without damaging the body 1420. For example, as shown in FIG. 14B, there can be one or more apertures 1425 that traverse one or more walls 1421 of the body 1420 of the sealing member 1404. Each aperture 1425 allows air to transfer from inside the cavity 1422 to outside the cavity 1422 when the sealing member 1404 is compressed or deformed, as shown in FIG. 19. In other words, the aperture 1425 reduces the compression force applied to the body 1420 and allows the shape of the cavity 1422 to change without creating a tear in the wall 1421 of the body 1420. Similarly, when the sealing member 1404 is no longer compressed or deformed, each aperture 1425 can allow air to transfer from outside the cavity 1422 to inside the cavity 1422, returning the shape of the cavity 1422 substantially to its original form.

As illustrated in FIG. 19, one of the walls 1421 of the sealing member abuts against the first section 1106 of the curved wall 1101 of the collar section 626 and another wall 1421 of the sealing member abuts against the second portion 1108 of the curved wall 1101 of the collar section 626 and the outer surface of a side wall of the recessed housing can 1402. Further, yet another wall 1421 of the sealing member 1404 abuts against a portion of the ceiling 1604 to hold the sealing member 1404 in position and prevent the sealing member 1404 from sliding down the side wall 1401 of the recessed housing can 1402. In particular, as illustrated in FIG. 19, the aperture 1425 formed in the sealing member 1404 may allow the sealing member 1404 to be deformed such that the sealing member 1404: (a) adapts to the shape of the gap in which the sealing member 1404 is disposed, and (b) forms an air-tight seal between the itself, and the members it abuts.

In addition to the collar having the multiple collar sections 626, the plurality of sealing features of the base plate 603 may include one or more sealing tabs 614 that may be disposed in between the multiple collar sections 626. Each sealing tab 614 may include a first portion 691 (shown in FIG. 6) that extends inward towards the can receiving opening 612 and slopes upward from a portion of the perimeter of the can receiving opening 612. The first portion 691 may form an obtuse angle with the base wall 604 of the base plate 603. In certain example embodiments, the obtuse angle formed by the first portion 691 of the sealing tab 614 with the base wall 604 may be substantially similar or equal to the obtuse angle formed by the first portion 1106 of the collar sections 626 with the base wall 604. In particular, the sealing tabs 614 are disposed in between the multiple collar sections 626 such that the first portion 691 (interchangeably referred to as 'base portion 691') of the sealing tabs 614 that extend inward towards the can receiving opening 612 from a perimeter of the can receiving opening 612 may form a substantially annular and continuous body 679 (shown in FIG. 7) with the first portion 1106 (interchangeably referred to as 'base portion 1106') of the collar sections 626 that extend inward towards the can receiving opening 612 from a perimeter of the can receiving opening 612.

Each sealing tab 614 may further include a second portion 692 that extends further upward from the first portion 691 and substantially perpendicular to the base wall 604 of the base plate 603. The second portion 692 of each sealing tab 614 may include a coupling aperture 616 formed therein. The coupling aperture 616 of the sealing tab 614 may be a through aperture that is configured to receive a fastening device 1406 therethrough to create an air-tight seal between the sealing tab 614 and the recessed housing can 1402 as described below in further detail.

As illustrated in FIG. 14A, the recessed housing can 1402 may include a side wall 1401 that defines an inner cavity 1403 (shown in FIGS. 19 and 20). The inner cavity 1403 may be configured to receive and retain a light source and/or one or more electronic components associated with the light source (not shown). Further, the side wall 1401 of the recessed housing can 1402 may include one or more adjustment apertures 1407, e.g., elongated slots, that are configured to adjustably mount the recessed housing can 1402 in ceilings having different thicknesses. These adjustment apertures 1407 may expose the cavity 1403 and components, such as light source (not shown), disposed therein to the external environment and may allow air to escape out from the cavity 1403, which may be undesirable. Accordingly, it may be desirable to seal the adjustment apertures 1407 of the recessed housing can 1402 when it is retained within the base plate 603 of the plaster frame assembly 600.

Figure 15:
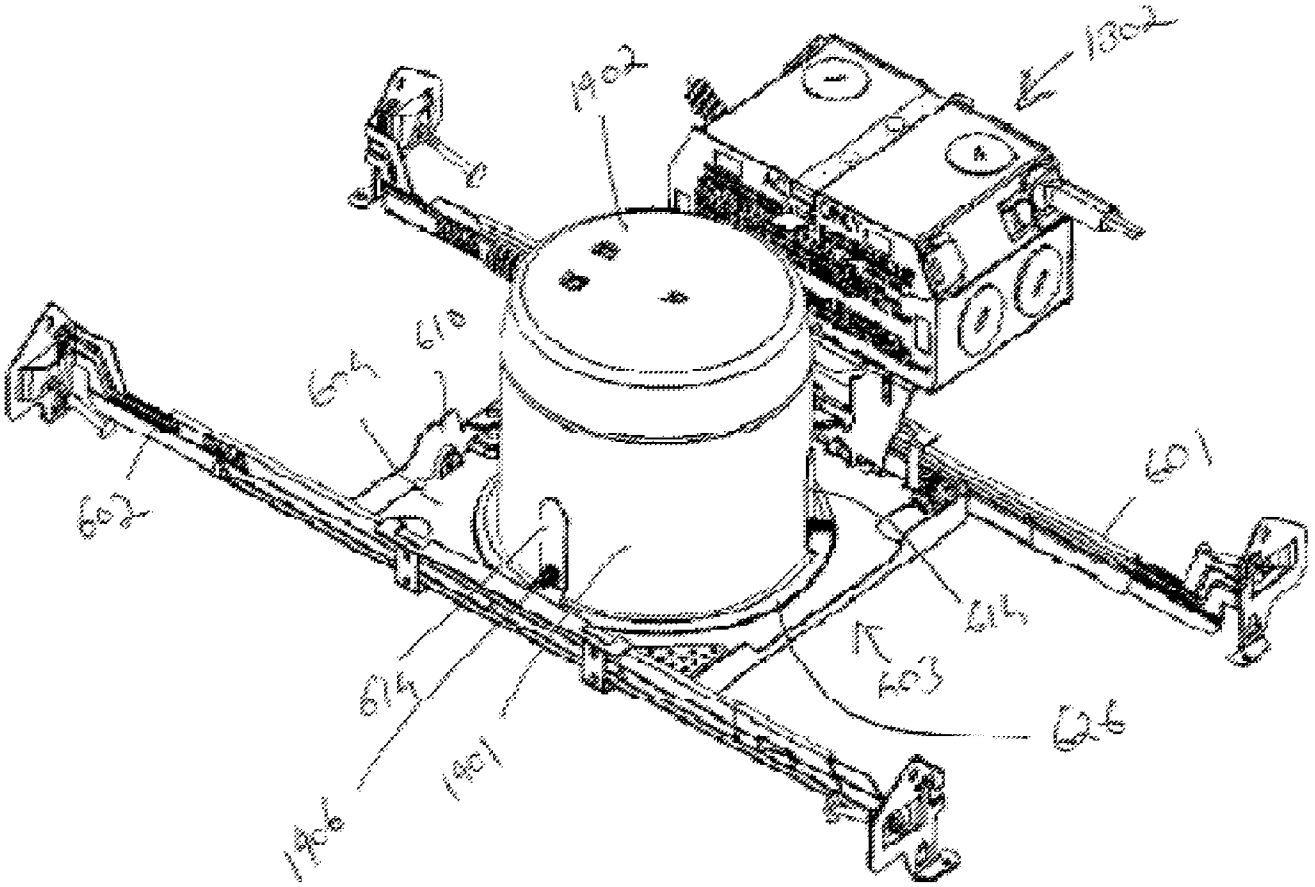
FIG. 15 illustrates a perspective view of the plaster frame assembly with the junction box and the housing can, in accordance with example embodiments of the present disclosure.

In particular, to retain the recessed housing can 1402 within the base plate 603 of the plaster frame assembly 600 and to seal the adjustment apertures 1407 of the recessed housing can 1402, the recessed housing can 1402 may be positioned below the ceiling 1604 such that the recessed housing can 1402 is axially aligned with a recessed luminaire opening 2007 (shown in FIGS. 19 and 20) of the ceiling 1604 and the can receiving opening 612 of the base plate 603. After positioning the recessed housing can 1402 below the ceiling 1604, the user may push the recessed housing can 1402 up towards the ceiling 1604 and through the recessed luminaire opening 2007 in the ceiling 1604 and the can receiving opening 612 of the base plate 603 till: (a) a bottom edge 1409 of the recessed housing can 1402 is flush with a bottom surface 1603 of the ceiling 1604, and (b) the adjustment apertures 1407 of the recessed housing can 1402 are aligned with the sealing tabs 614 of the base plate 603. Then, a fastening device 1406 can be directed from within the cavity 1403 of the recessed housing can 1402, through each adjustment aperture 1407 (slot) in the side wall 1401 of the recessed housing can 1402, and through the respective coupling aperture 616 in the sealing tab 614 of the base plate 603. As the fastening device 1406 is driven further outward (tightened), each sealing tab 614 of the base plate 603 is drawn toward the respective adjustment aperture 1407 disposed on the side wall 1401 of the recessed housing can 1402. Eventually, as illustrated in FIGS. 15, 18, and 19, substantially all of each sealing tab 614 abuts against substantially all of the respective adjustment aperture 1407 disposed on the side wall 1401 of the recessed housing can 1402 to form an air-tight seal between the sealing tabs 614 of the base plate 603 and the adjustment apertures 1407 of the recessed housing can 1402. In so doing, any portions of the adjustment aperture 1407 (in the case of a slot) in the recessed housing can 1402 that is not occupied by the fastening device 1406 is covered by the sealing tab 614. The air-tight seal may prevent or restrict dust, moisture, and/or other contaminants from entering the recessed housing can 1402 when the coupling feature 1206 is mechanically coupled to the coupling feature 1258. In addition, or in the alternative, the air-tight seal created between the sealing tab 614 and the adjustment aperture 1407 can prevent or restrict air from within the recessed housing can 1402 from escaping.

Although the present disclosure is described with reference to example embodiments, it should be appreciated by those skilled in the art that various modifications are well within the scope of the present disclosure. From the foregoing, it will be appreciated that an embodiment of the present disclosure overcomes the limitations of the prior art. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art. Therefore, the scope of the present disclosure is not limited herein.

What is claimed is:

1. A plaster frame assembly comprising:

a base plate, the base plate comprising:

a can receiving opening formed in the base plate and configured to receive a recessed housing can of a recessed luminaire therethrough;

a plurality of sealing features that are disposed at a perimeter of the can receiving opening and configured to provide an air-tight seal for the recessed housing can, the plurality of sealing features comprising:

a first collar section and a second collar section, the first and second collar sections extending inward toward the can receiving opening from at least a portion of the perimeter of the can receiving opening, wherein the first collar section and the second collar section define a groove having a substantially inverted V-shaped cross-sectional profile; and a sealing tab disposed between the first collar section and the second collar section, the sealing tab extending inward toward the can receiving opening from a remainder portion of the perimeter of the can receiving opening.

2. The plaster frame assembly of claim 1, further comprising a third collar section.

3. The plaster frame assembly of claim 2, further comprising:

a second sealing tab disposed between the second collar section and the third collar section; and a third sealing tab disposed between the third collar section and the first collar section.

4. The plaster frame assembly of claim 1, wherein the base plate further comprises a plurality of side walls that extend from a perimeter of a base wall of the base plate and substantially perpendicularly to the base wall, and wherein at least one regressed pad comprising a plurality of perforations is disposed between the plurality of side walls and the can receiving opening.

5. The plaster frame assembly of claim 1, wherein the groove is configured to receive a flexible sealing member.

6. The plaster frame assembly of claim 5, wherein the flexible sealing member creates a seal between the plaster frame assembly and the recessed housing can.

7. The plaster frame assembly of claim 5, wherein the flexible sealing member has a triangular cross-sectional profile.

8. The plaster frame assembly of claim 1, wherein the first collar section and the second collar section each comprise:

a first portion that extends at an upward angle into the can receiving opening from the portion of the perimeter of the can receiving opening; and a second portion that extends substantially perpendicularly to and into the can receiving opening from an inner edge of the first portion.

9. The plaster frame assembly of claim 1, wherein the sealing tab comprises:

a base portion that extends at an upward angle into the can receiving opening from the remainder portion of the perimeter of the can receiving opening; and an elongate second portion that extends from the base portion and away from the can receiving opening.

10. The plaster frame assembly of claim 9, wherein the elongate second portion comprises an aperture.

11. The plaster frame assembly of claim 10, wherein the aperture is configured to receive a fastener to secure the sealing tab to the recessed housing can.

12. The plaster frame assembly of claim 11, wherein the fastener passes through the aperture in the sealing tab and through an adjustment aperture in the recessed housing can.

13. The plaster frame assembly of claim 12, wherein the sealing tab covers the adjustment aperture.

14. The plaster frame assembly of claim 1, wherein the base plate further comprises at least one regressed pad that includes a plurality of perforations formed in the base plate, the plurality of perforations being configured to receive one or more securing fasteners therethrough to fasten the base plate to a ceiling.

15. The plaster frame assembly of claim 14, wherein the plurality of perforations include circular through holes.

16. The plaster frame assembly of claim 14, wherein the plurality of perforations include elongated through slots.

17. The plaster frame assembly of claim 14, wherein the at least one regressed pad is elevated above a base wall of the base plate.

18. The plaster frame assembly of claim 1, wherein the base plate further comprises a coupling feature to receive a junction box.

19. The plaster frame assembly of claim 1, wherein the base plate comprises:

a first side wall with first attachment tabs configured to couple to a first hanger bar assembly; and a second side wall with second attachment tabs configured to couple to a second hanger bar assembly.

* * * * *